US005502556A

United States Patent [19]

Yamada

[11] Patent Number: 5,502,556

[45] Date of Patent: Mar. 26, 1996

[54] AUTOMATIC DOCUMENT FEEDING APPARATUS FOR FEEDING TWO-SIDED DOCUMENTS

[75] Inventor: Yasushi Yamada, Hachioji, Japan

[73] Assignee: Konica Corporation, Tokyo, Japan

[21] Appl. No.: 87,184

[22] Filed: Jul. 6, 1993

[30] Foreign Application Priority Data

Jul. 14, 1992 [JP] Japan ..... 4-187143
Jul. 14, 1992 [JP] Japan ..... 4-187159

[51] Int. Cl.[6] ..... G03G 21/00; G03G 15/00

[52] U.S. Cl. ..... 355/320

[58] Field of Search ..... 355/318, 319, 355/320

[56] References Cited

U.S. PATENT DOCUMENTS

| | | | |
|---|---|---|---|
| 4,264,067 | 4/1981 | Adams et al. | 355/319 X |
| 4,264,187 | 4/1981 | Rhodes | 355/320 |
| 4,384,782 | 5/1983 | Acquaviva | 355/318 |
| 4,456,236 | 6/1984 | Buddendeck | 355/320 X |
| 4,705,389 | 11/1987 | Maekawa et al. | 355/319 X |
| 5,258,817 | 11/1993 | Acquaviva | 355/320 |
| 5,343,281 | 8/1994 | Yamada | 355/320 |

FOREIGN PATENT DOCUMENTS

| | | |
|---|---|---|
| 60-140364 | 7/1985 | Japan . |
| 2-8162 | 1/1990 | Japan . |
| 4-81865 | 3/1992 | Japan . |
| 5-45965 | 2/1993 | Japan . |
| 5-165284 | 7/1993 | Japan . |

*Primary Examiner*—Fred L. Braun
*Attorney, Agent, or Firm*—Frishauf, Holtz, Goodman, Langer & Chick

[57] ABSTRACT

An automatic document feeder, for conveying plural documents to an image reading section of a scanner includes; a first conveyer for separately conveying each of the plural documents from a document stack section to the scanner for reading an image on each of the plural documents at the scanner; a second conveyer for conveying the documents from the scanner to document reversing rollers, the document reversing rollers turning over the documents; a third conveyer for conveying the documents from the document reversing rollers to the scanner; and a document discharger for discharging the documents from the scanner to a document stack section of the apparatus. In the operation of the document feeder, while a first document is conveyed and turned over by one of the second conveyer, the document reversing rollers, and the third conveyer after a reading operation of the scanner to read an image on a first surface of the first document, a second document is started to be conveyed by the first conveyer; and when the first document is conveyed to the scanner so that an image on a second surface of the first document is read by the scanner, the second document is conveyed to a waiting position.

20 Claims, 15 Drawing Sheets

FIG. 5 (E)
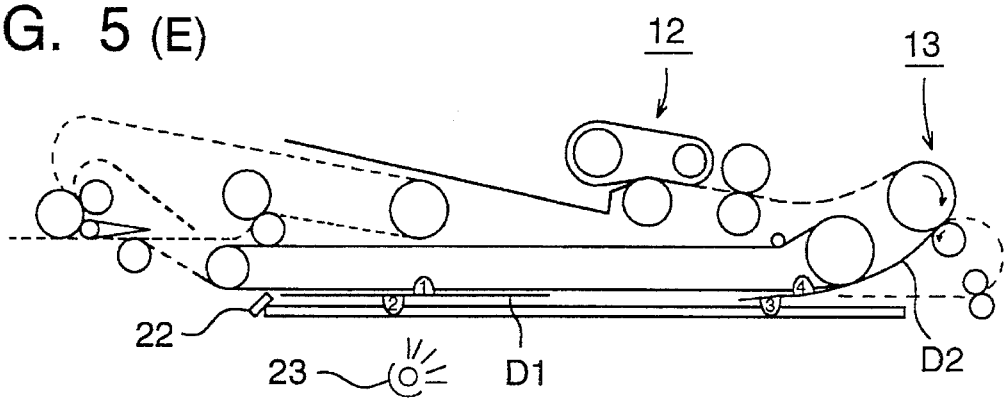
FIG. 5 ( F )
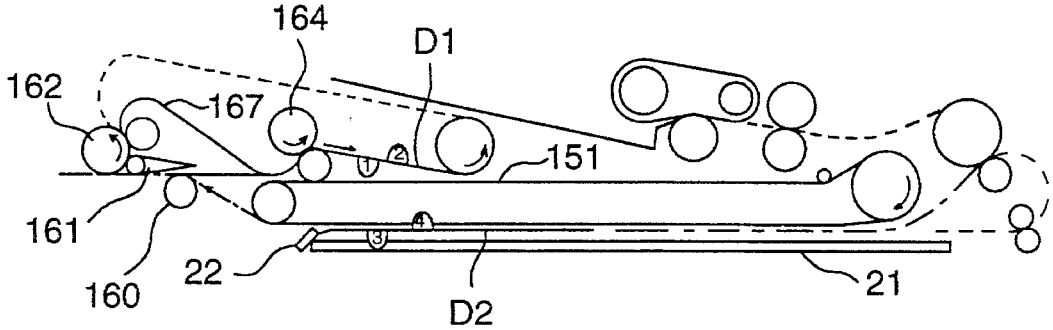
FIG. 5 ( G )
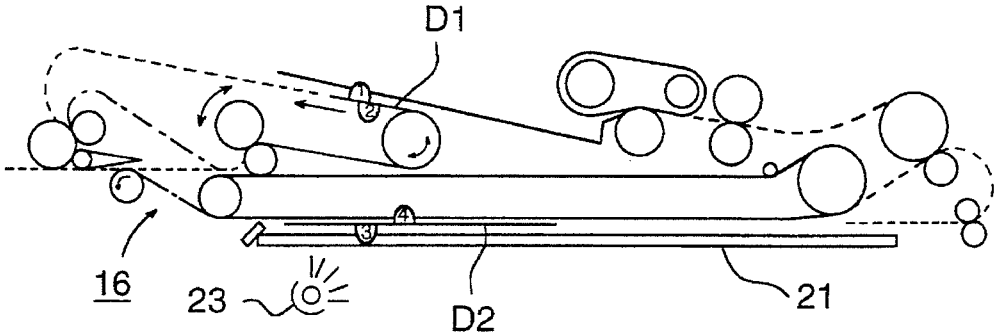

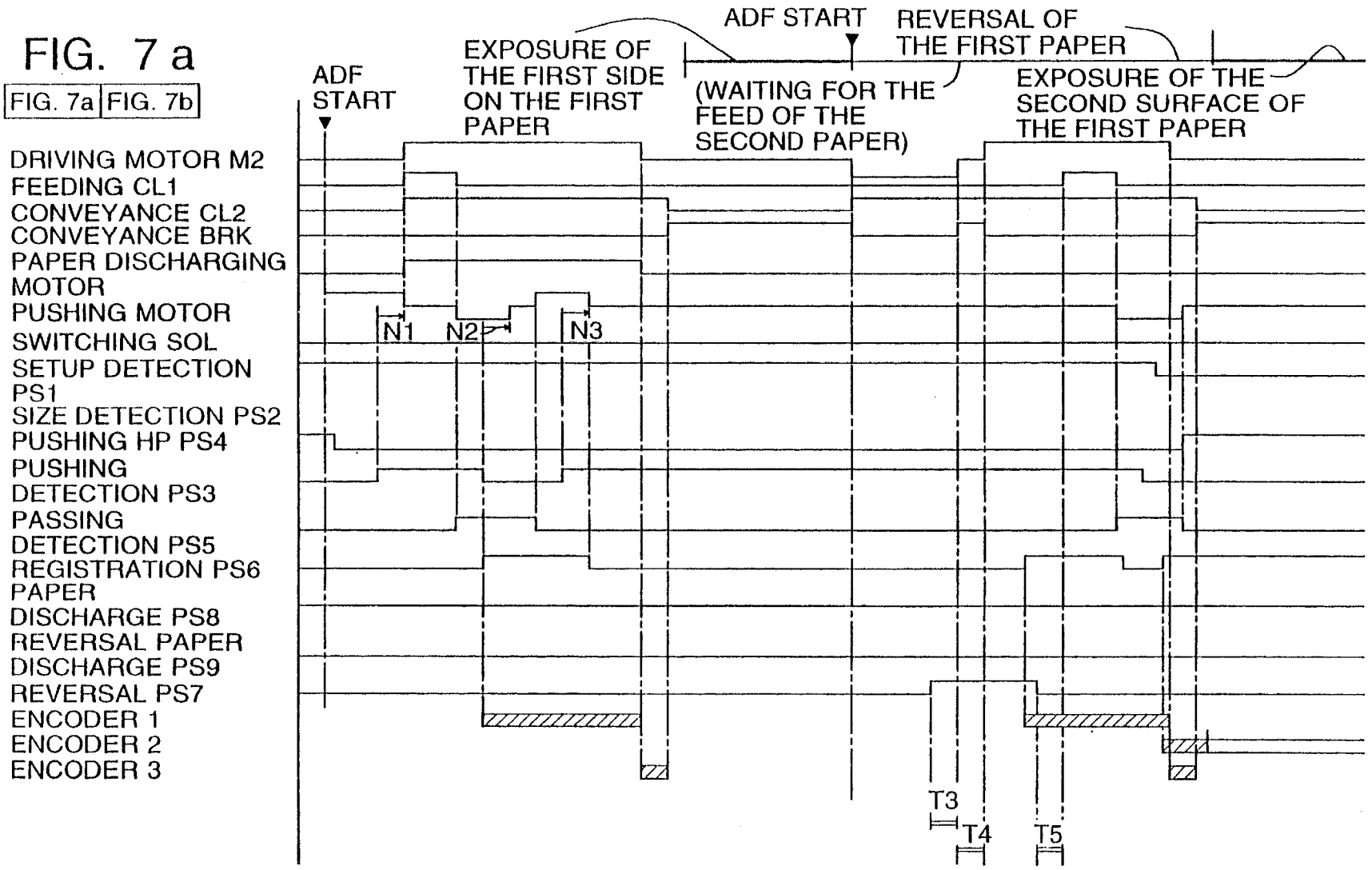
FIG. 7a
FIG. 7a FIG. 7b
DRIVING MOTOR M2
FEEDING CL1
CONVEYANCE CL2
CONVEYANCE BRK
PAPER DISCHARGING MOTOR
PUSHING MOTOR
SWITCHING SOL
SETUP DETECTION PS1
SIZE DETECTION PS2
PUSHING HP PS4
PUSHING DETECTION PS3
PASSING DETECTION PS5
REGISTRATION PS6
PAPER DISCHARGE PS8
REVERSAL PAPER DISCHARGE PS9
REVERSAL PS7
ENCODER 1
ENCODER 2
ENCODER 3
ADF START
EXPOSURE OF THE FIRST SIDE ON THE FIRST PAPER
N1
N2
N3
ADF START
(WAITING FOR THE FEED OF THE SECOND PAPER)
REVERSAL OF THE FIRST PAPER
EXPOSURE OF THE SECOND SURFACE OF THE FIRST PAPER
T3
T4
T5

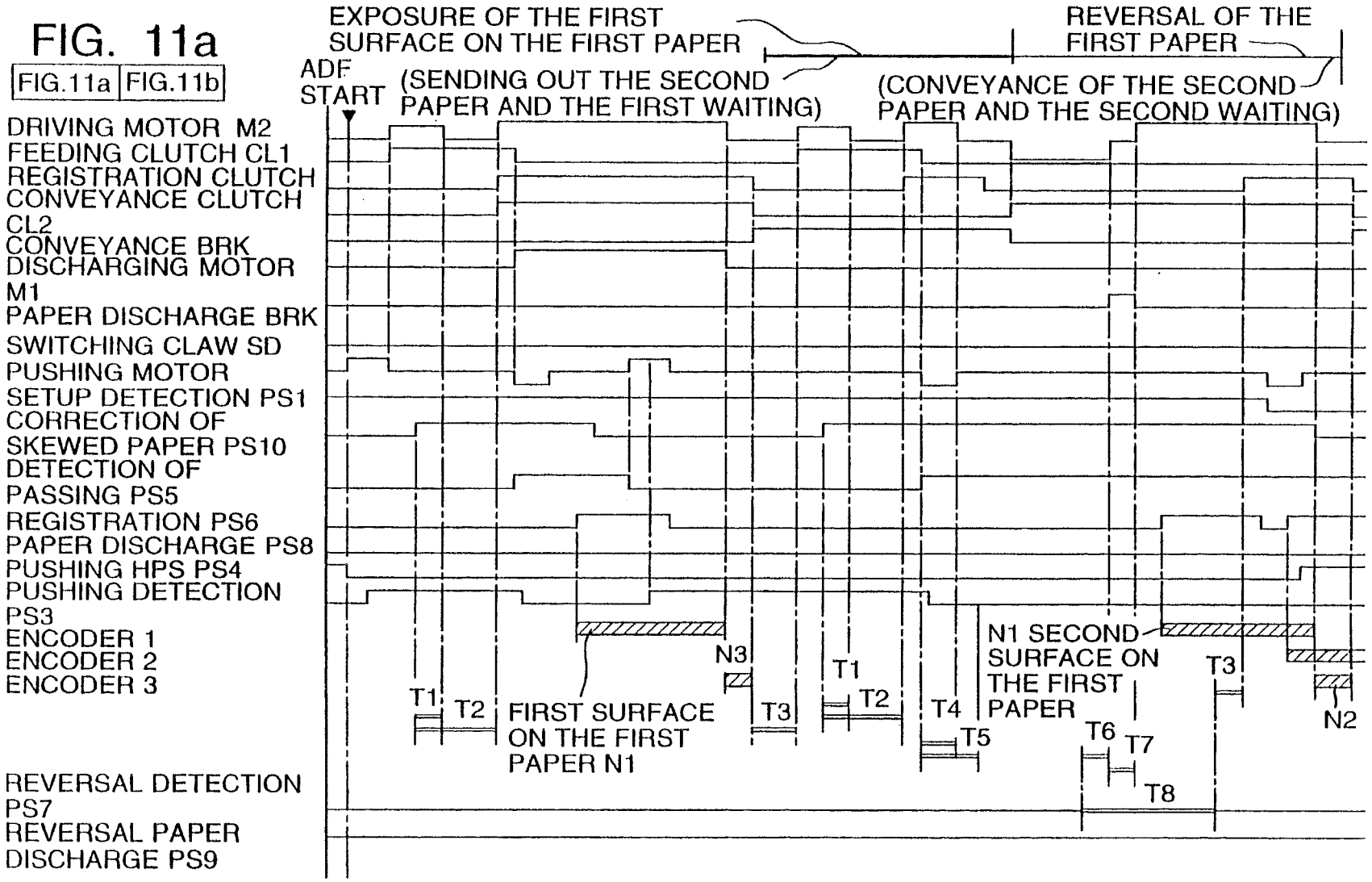
FIG. 11a
FIG.11a FIG.11b
DRIVING MOTOR M2
FEEDING CLUTCH CL1
REGISTRATION CLUTCH
CONVEYANCE CLUTCH
CL2
CONVEYANCE BRK
DISCHARGING MOTOR
M1
PAPER DISCHARGE BRK
SWITCHING CLAW SD
PUSHING MOTOR
SETUP DETECTION PS1
CORRECTION OF
SKEWED PAPER PS10
DETECTION OF
PASSING PS5
REGISTRATION PS6
PAPER DISCHARGE PS8
PUSHING HPS PS4
PUSHING DETECTION
PS3
ENCODER 1
ENCODER 2
ENCODER 3
REVERSAL DETECTION
PS7
REVERSAL PAPER
DISCHARGE PS9
ADF
START
EXPOSURE OF THE FIRST
SURFACE ON THE FIRST PAPER
(SENDING OUT THE SECOND
PAPER AND THE FIRST WAITING)
(CONVEYANCE OF THE SECOND
PAPER AND THE SECOND WAITING)
REVERSAL OF THE
FIRST PAPER
T1
T2
T3
T4
T5
T6
T7
T8
N1
N2
N3
FIRST SURFACE
ON THE FIRST
PAPER N1
N1 SECOND
SURFACE ON
THE FIRST
PAPER

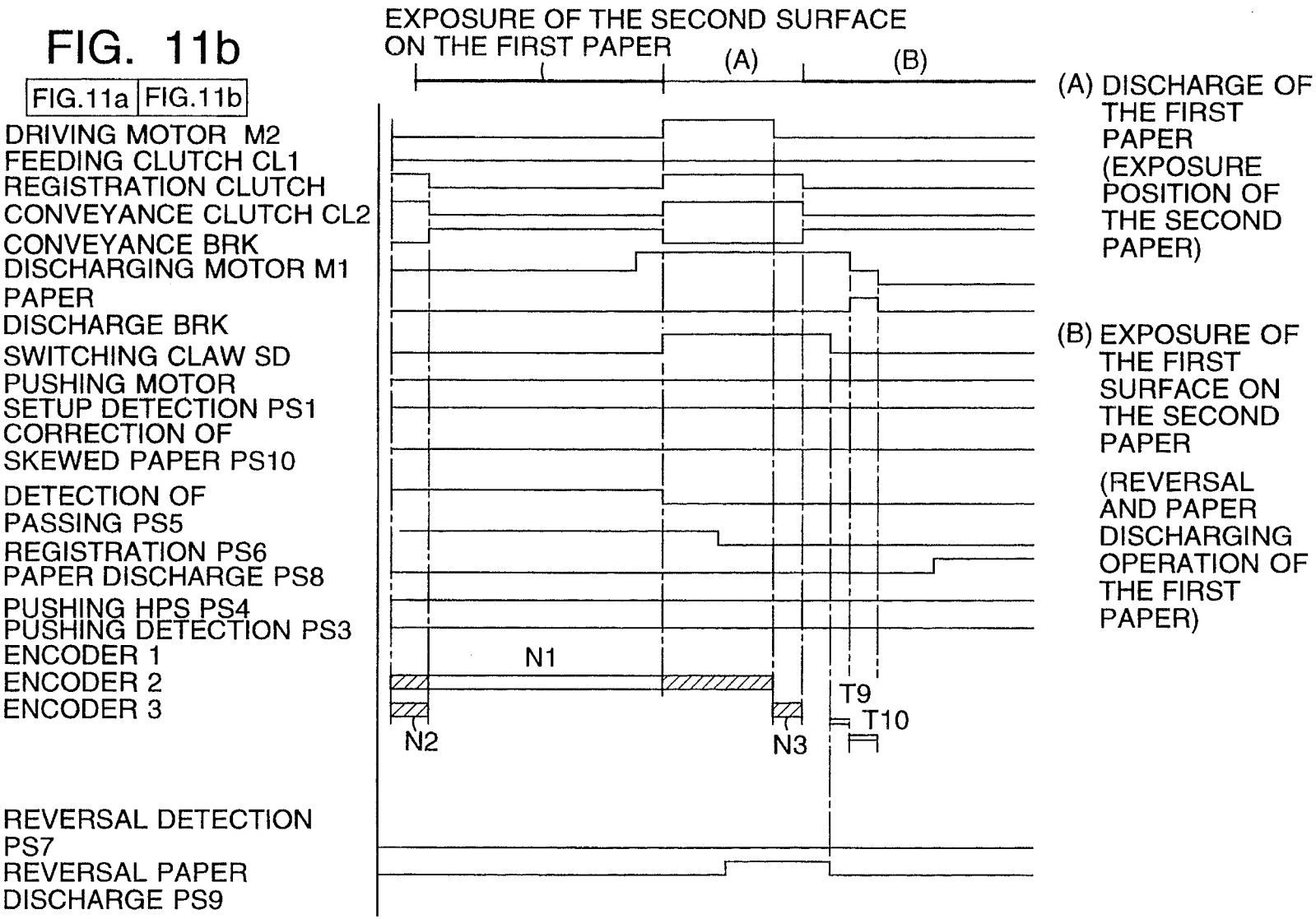
FIG. 11b
FIG.11a
FIG.11b
DRIVING MOTOR M2
FEEDING CLUTCH CL1
REGISTRATION CLUTCH
CONVEYANCE CLUTCH CL2
CONVEYANCE BRK
DISCHARGING MOTOR M1
PAPER
DISCHARGE BRK
SWITCHING CLAW SD
PUSHING MOTOR
SETUP DETECTION PS1
CORRECTION OF
SKEWED PAPER PS10
DETECTION OF
PASSING PS5
REGISTRATION PS6
PAPER DISCHARGE PS8
PUSHING HPS PS4
PUSHING DETECTION PS3
ENCODER 1
ENCODER 2
ENCODER 3
REVERSAL DETECTION
PS7
REVERSAL PAPER
DISCHARGE PS9
EXPOSURE OF THE SECOND SURFACE
ON THE FIRST PAPER
(A)
(B)
N1
N2
N3
T9
T10
(A) DISCHARGE OF THE FIRST PAPER (EXPOSURE POSITION OF THE SECOND PAPER)
(B) EXPOSURE OF THE FIRST SURFACE ON THE SECOND PAPER (REVERSAL AND PAPER DISCHARGING OPERATION OF THE FIRST PAPER)

AUTOMATIC DOCUMENT FEEDING APPARATUS FOR FEEDING TWO-SIDED DOCUMENTS

BACKGROUND OF THE INVENTION

The present invention relates to an automatic document feeding apparatus, and more particularly to an improvement in an apparatus for automatically conveying a document to a predetermined reading position in a recording device or an image reading device of an electrophotographic copier.

An automatic document feeder is generally provided on a platen glass in an image exposure section of a copier. In an optical system movement type copier to which the automatic document feeder is provided, documents are conveyed as follows: documents are sent out from a document stack tray (stack section) by the automatic document feeder one by one; conveyed onto the platen glass by a conveyance belt; and after the documents have been exposed by an exposure lamp provided in the copier body, they are discharged onto a document discharge tray.

In a conventional automatic document feeder, the document feeding operation is carried out in the following manner:

after a paper discharge sensor has detected that a document on the platen has been discharged, the following document is sent out from the stack section onto the platen glass, and stopped at a predetermined position. Therefore, it takes a long period of time to replace a document placed on the platen. Accordingly, a large amount of time is required for a copying operation, and the productivity is low.

In the case where an automatic document feeder is used, the copying productivity can be increased to 100% when a document is replaced within a period of time in which the optical scanning system is returned. In order to replace the document within the period of time in which the optical scanning system is returned, it is necessary to increase the document conveyance speed when the document is conveyed from a double feeding prevention device of the document stack section to a document stop position on the platen glass.

However, in order to convey the document at high speed, various problems are caused, such as an increase in the motor dimensions, an increase in electrical power consumption, noises, abrasion of the conveyance belt, damage of the document, and deterioration of the document separation property.

In the case where a two-sided document is copied, the two-sided document is conveyed onto a platen glass. After the first surface of the document has been exposed, it is reversed by a document reversal conveyance means, and conveyed again onto the platen glass, and the second surface of the document is exposed. After that, the document is reversed again by the document reversal conveyance means, and then the document is discharged outside of the apparatus under the condition that the discharged documents are collated. In the above automatic document feeding apparatus for feeding two-sided documents, an interval between the trailing end of the first document and the leading end of the second document is long. Therefore, the second document travels over a long distance in the case where the document is replaced or reversed. Accordingly, a period of time required for replacing a document is disadvantageously increased.

In order to overcome the disadvantages described above, the present applicant has proposed the following automatic document feeding apparatus disclosed in Japanese Patent Publication Open to Public Inspection No. 330736/1991 (corresponding to Japanese Patent Publication No. 5-165284). While the second surface of the previous document is being read (that is, while the conveyance belt is stopped), the next document is sent from a document tray. The document is made to wait for the next operation at a position close to the upstream of the conveyance belt. When the previous document is discharged after the reading operation of its second surface has been completed, the next document that has been waiting for the following operation is conveyed to the reading position.

However, in the apparatus constituted in the manner described above, an interval between the trailing end of the previous document and the leading end of the next document is restricted by a positional relation between the reading section on the platen glass and the upstream end portion of the conveyance belt (that is, the interval is restricted by a distance from the upstream end portion of the conveyance belt to the reading position). Therefore, it is impossible to reduce the interval between the trailing end of the previous document and the leading end of the next document for the purpose of shortening the document replacing time.

The present invention has been achieved in consideration of the aforementioned problems. It is an object of the present invention to reduce a period of time required for replacing a document in order to increase the copying speed when the next document is conveyed to a position as close to the previous document as possible while the second surface of the previous document is being read, without being restricted by the conveyance distance of the conveyance belt. Also, it is another object of the present invention to stabilize a paper discharging operation while the reduction of the document replacing time is realized.

SUMMARY OF THE INVENTION

In order to accomplish the objects, the automatic document feeding apparatus of the first example of the present invention comprises: a paper feeding means that feeds documents one by one from a document stack provided on a document tray; a reading section that reads image information on one side or both sides of the document; a conveyance means that can convey the document fed by the paper feeding means, onto the reading section; a reversal means provided adjacent to the conveyance means, the reversal means reversing the document conveyed from the reading section by the conveyance means, the reversal means feeding the document to the conveyance means so as to convey it to the reading position again; a discharged paper stack section that stacks the documents discharged from the reading section; and a paper discharging means that discharges the document from the reading section to the discharged paper stack section, wherein the second document is sent out by the paper feeding means while the first document, the first surface of which has been read by the reading section, is reversed by the reverse means and conveyed to the reading section again; the first document in a reversal operation and the second document are conveyed to the conveyance direction; the second document is conveyed to a waiting position located upstream of the first document by a predetermined interval concurrently when the second surface of the first document has reached the reading position; and the first document is discharged after the second surface of the first document has been read and at the same time the first surface of the second document is conveyed to the reading position from the waiting position.

In the case where the conveyance means is an endless belt provided between two shafts, the waiting position is preferably located in such a manner that the leading end of the second document is in the middle of the endless belt.

The paper discharging means comprises: a first paper discharging means disposed downstream of the reading section and the conveyance means, the first paper discharging means discharging the documents onto the discharged paper stack portion under the condition that the front and reverse surfaces of the documents in the reading position are not changed; a second paper discharging means disposed downstream of the reading section and the conveyance means, the second paper discharging means discharging the documents onto the discharged paper stack section under the condition that the front and reverse surfaces of the documents in the reading position are changed, wherein the conveyance means selectively carries out the following two operations according to the two-sided document reading mode or the one-sided document reading mode, one is an operation in which the conveyance means discharges the documents onto the discharged paper stack section under the condition that the front and reverse sides of the documents in the reading position are not changed, and the other is an operation in which the conveyance means discharges the documents onto the discharged paper stack section under the condition that the front and reverse sides of the documents in the reading position are changed.

In this case, the operation of the paper discharging means may be completed at least in a period from the reading operation of the first surface of the second document to the completion of the reading operation of the second surface of the second document.

One of the paper discharging means may be provided with a means by which the leading and trailing ends of a document are reversed in a region from the reading section to the discharged paper stack section, and in the case of the two-sided document reading mode, the operation of the means by which the leading and trailing ends of a document are reversed may be selected.

Moreover, in the case of document replacement, at least until the trailing end of a document passes through the reading section, the paper discharging speed of the paper discharging means is made to be not less than the conveyance means speed of the reading section, and before the paper discharging operation is completed in the discharged paper stack section, the paper discharging speed of the paper discharging means may be switched to a lower speed than the conveyance means speed of the reading section.

The discharged paper stack section may be a document tray, and the documents discharged by the paper discharging means may be circulated onto the document tray.

In the apparatus of the present invention, the operation is performed as follows: in the case of reading a two-sided document, the first document, the first surface of which has already been read in the reading section, is reversed by the reversal means, and while the first document is being conveyed to the reading section again, the second document is sent out by the paper feeding means, so that the previous document in the reversal operation and the second document are conveyed in the conveyance direction; concurrently when the second surface of the first document has reached the reading position, the next document is conveyed to the waiting position located upstream of the first document by a predetermined distance; after the second surface of the first document has been read, the document is conveyed to one of the paper discharging means, which has previously been selected, and at the same time, the first surface of the second document is conveyed to the reading position from the waiting position; and a paper discharging operation of the document conveyed to the paper discharging means is completed at least in a period of time from the first surface reading operation of the second document conducted in the reading section to the completion of the second surface reading.

According to the automatic document feeding apparatus of the first example, while the previous document is reversed and conveyed so as to read the second surface, the second document is sent out, and the reversed first document and the second document are concurrently conveyed to the conveyance direction. Concurrently when the second surface of the first document has reached the reading position, the second document is conveyed to the upstream waiting position. In other words, the reversed previous document and the next document are concurrently conveyed, and an interval between the trailing end of the first document and the leading end of the second document is reduced to a sufficiently small value.

In the case where a conveyance means is applied in which an endless belt is provided between two shafts, at least when the leading end of the second document is located in the middle of the endless belt, the second document can wait for the following operation at a position closest to the first document.

According to the mode of reading, that is, according to the two-sided document reading mode or the one-sided document reading mode, one of the following document discharging procedures can be selected. One is a procedure in which a document in the reading position is discharged while its front and reverse sides are not changed, and the other is a procedure in which a document in the reading position is discharged while its front and reverse sides are changed. As a result of the foregoing, documents can be discharged under the condition that the first surfaces of the documents are arranged in a predetermined direction.

The paper discharging operation of the first document can be performed without interfering with the paper discharging operation of the second document when the paper discharging operation of the first document is completed in a period of time from the first surface reading operation of the second document to the completion of the second surface reading operation of the next document.

In the two-sided document reading mode, when leading and trailing ends are reversed at a position between the reading section and the discharged paper tray, documents can be discharged under the condition that the relation of their leading and trailing ends on the document tray is maintained constant.

When the paper discharging speed is equal to or higher than the speed of the conveyance means in the reading section until the trailing end of a document has passed through the reading section, and when the paper discharging speed of the paper discharging means is switched to a lower value before the completion of paper discharging onto the discharged paper tray, the discharged documents can be excellently aligned on the tray due to the reduction of the discharging speed.

In the case where the discharged paper tray and the document tray are not provided separately but integrated into one unit, the documents can be circulated when the read documents are discharged onto the document tray.

When the reversed first document and the second document are conveyed in the conveyance direction, and concurrently when the second surface of the first document has reached the reading position, the next document is conveyed to the waiting position located upstream by a predetermined interval. When the document replacing time is reduced in the aforementioned manner, and when the first document is discharged in a period of time from the first surface reading to the completion of the second surface reading operation of the second document, the discharging operation of the first document can be gently conducted in a period of time when both sides of the second document is read.

In order to accomplish the objects, the automatic document feeding apparatus of the second example of the present invention comprises: a paper feeding means that feeds documents one by one from a document stack provided on a document tray; a reading section that reads image information on one side or both sides of the document; a conveyance means that can convey the document fed by the paper feeding means, onto the reading section; a reversal means provided adjacent to the conveyance means, the reversal means reversing the document conveyed from the reading section by the conveyance means, the reversal means feeding the document to the conveyance means so as to convey it to the reading position again; a discharged paper stack section that stacks the documents discharged from the reading section; and a paper discharging means that discharges the document from the reading section to the discharged paper stack section, wherein the second document is sent out from the document tray and made to wait for the following operation at the first waiting position before the reading operation of the first surface of the first document is completed, the conveyance of the waiting document is started while the first document, the first surface of which has been read, is reversed by the reversal means and conveyed again to the reading section, the first document in a reversal operation and the second document are conveyed in the conveyance direction, the second document is conveyed to the second waiting position located upstream by a predetermined distance from the previous document concurrently when the second surface of the first document has reached the reading position, and after the reading of the second surface of the first document has been completed, the read document is discharged, and at the same time the first surface of the second document is conveyed from the second waiting position to the reading position.

In this case, it is preferable that an intermediate conveyance section is provided between the paper feeding section and the reversal means, and that the first waiting position for the second document is located outside of the document conveyance path in the reversal means and before the conveyance means.

Also, it is preferable that the posture of a document is corrected while the document waits for the following operation at the first waiting position.

In the case where the conveyance means is composed of an endless belt provided between two shafts, it is preferable that the second waiting position is located in such a manner that the leading end of the second document is positioned in the middle of the endless belt.

It is also preferable that the discharging operation of a document conveyed to the paper discharging means after reading is completed at least in a period of time from the start of reading of the first surface on the second document to the completion of reading of the second surface.

It is preferable that the discharged paper tray is composed of a document tray and that the discharged documents are circulated from the paper discharging means to the document tray.

According to the automatic document feeding apparatus of the second example, the operation is performed as follows: The second document is sent out from the document tray and made to wait for the following operation at the first waiting position before the reading operation of the first surface of the first document is completed, the conveyance of the waiting document is started while the first document, the first surface of which has been read, is reversed by the reversal means and conveyed again to the reading section, the first document in a reversal operation and the second document are conveyed in the conveyance direction, the second document is conveyed to the second waiting position located upstream by a predetermined distance from the first document concurrently when the second surface of the first document has reached the reading position, and after the reading of the second surface of the first document has been completed, the read document is discharged, and at the same time the first surface of the second document is conveyed from the second waiting position to the reading position.

In the concurrent conveyance operation described above, a document is previously separated from the document tray and fed to the first waiting position so as to wait for the following operation, so that the separation of the document from the document tray and the conveyance of the document to the second waiting position are not continuously conducted, but after the second document has been separated from the document tray, it is conveyed to the second waiting position.

Since the reversed first document and the second document are concurrently conveyed in the conveyance direction and the second document is made to wait for the following operation at the second waiting position, it is possible that the interval between the trailing end of the first document and the leading end of the second document is sufficiently reduced to a small value.

In the case where an intermediate conveyance section is provided between the paper feeding section and the reversal section, when the first waiting position of the second document is located outside of the document conveyance path in the reversal means and before the conveyance means, the first waiting position does not interfere with the reversal operation of the first document, and further the waiting condition at the first waiting position can be stabilized, so that the document can be smoothly conveyed to the second waiting position.

When the document waits for the next operation at the first waiting position, a sufficient amount of time can be provided. Accordingly, the posture of the document can be excellently corrected at the first waiting position.

In the case of a conveyance means composed of an endless belt provided between two shafts, when the second waiting position for the second document is located in such a manner that at least the leading end of the second document is positioned in the middle of the endless belt, the second document can be made to wait for the following operation at a position closest to the first document without being restricted by the conveyance distance of the endless belt. Moreover, after the first document, the second document positioned close to the first document can be easily conveyed to the reading position.

When the discharging operation of a document conveyed to the paper discharging means after reading is completed at least in a period of time from the start of reading of the first surface on the second document to the completion of reading of the second surface, the paper discharging time can be increased by utilizing the reading time and reversal time of the second document. Therefore, the conveyance speed of the paper discharging means can be made lower than the document replacement speed, so that the discharged documents can be excellently aligned.

When the discharged paper tray and the document tray are not provided independently but are integrated into one unit and the read documents are discharged onto the document tray, the documents can be circulated.

BRIEF DESCRIPTION OF THE DRAWINGS

FIGS. 5(E) to 5(G) are schematic illustrations showing the document conveyance operational procedure of the first example;

FIGS. 11(*a*) and 11(*b*) is a time chart for feeding and conveying two-sided documents in the second example;

DETAILED DESCRIPTION OF THE INVENTION

With reference to the attached drawings, an example of the present invention will be explained in detail as follows.

Figure 1:
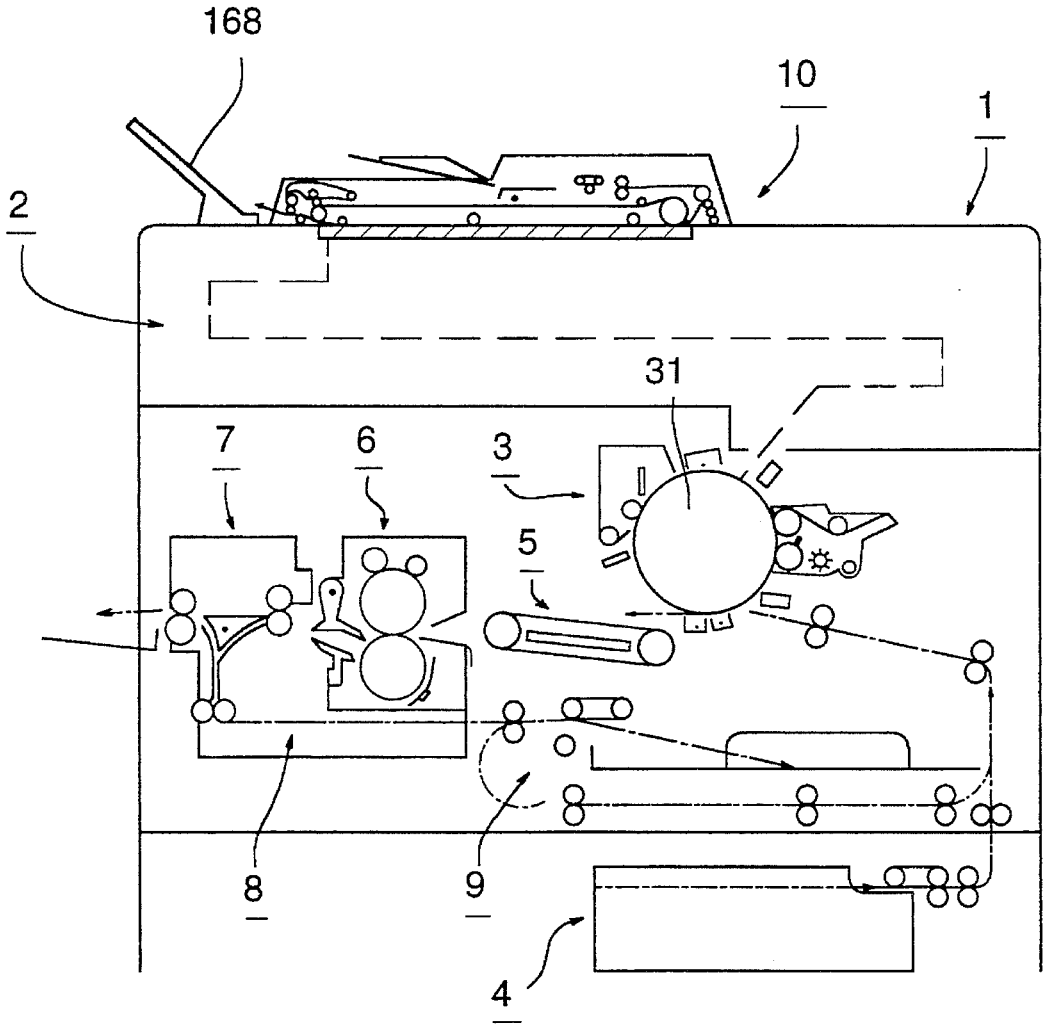
FIG. 1 is an overall view illustrating an image recording apparatus which incorporates the automatic document feeding apparatus of the present invention.

FIG. 1 is a schematic illustration showing the entire structure of an image recording apparatus (copier) to which the automatic document feeder of the present invention is provided. In FIG. 1, numeral 1 is a copier body, numeral 2 is an optical scanning exposure system, numeral 3 is an image forming means disposed around a photoreceptor drum 31, numeral 4 is a copy paper supply means (paper supply means), numeral 5 is a copy paper conveyance means, numeral 6 is a fixing unit, numeral 7 is a discharged paper inversion changeover means, numeral 8 is an inversion conveyance means, numeral 9 is a two-sided recording paper conveyance means (ADU), and numeral 10 is an automatic document feeder (RADF) having a two-sided document automatic inversion function.

Figure 2:
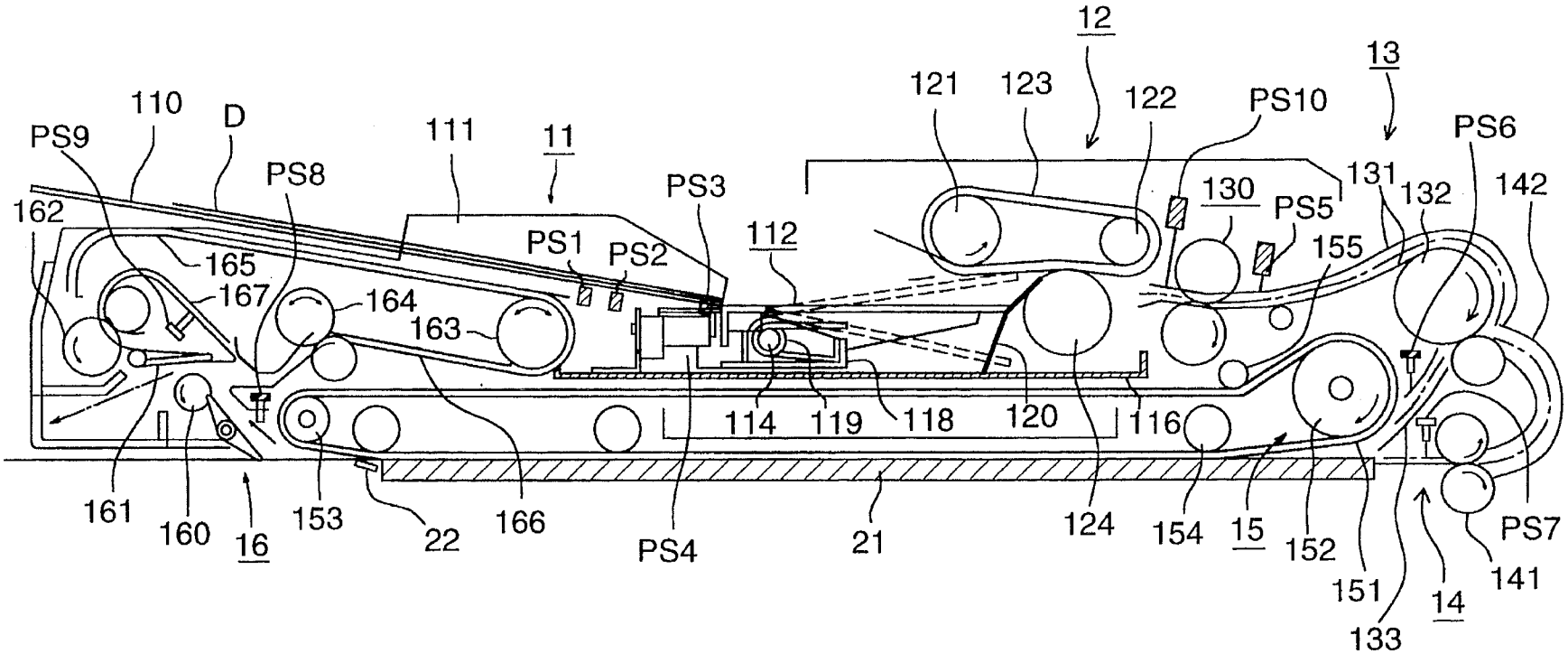
FIG. 2 is a sectional view of the automatic document feeding apparatus of the present invention.
Figure 3:
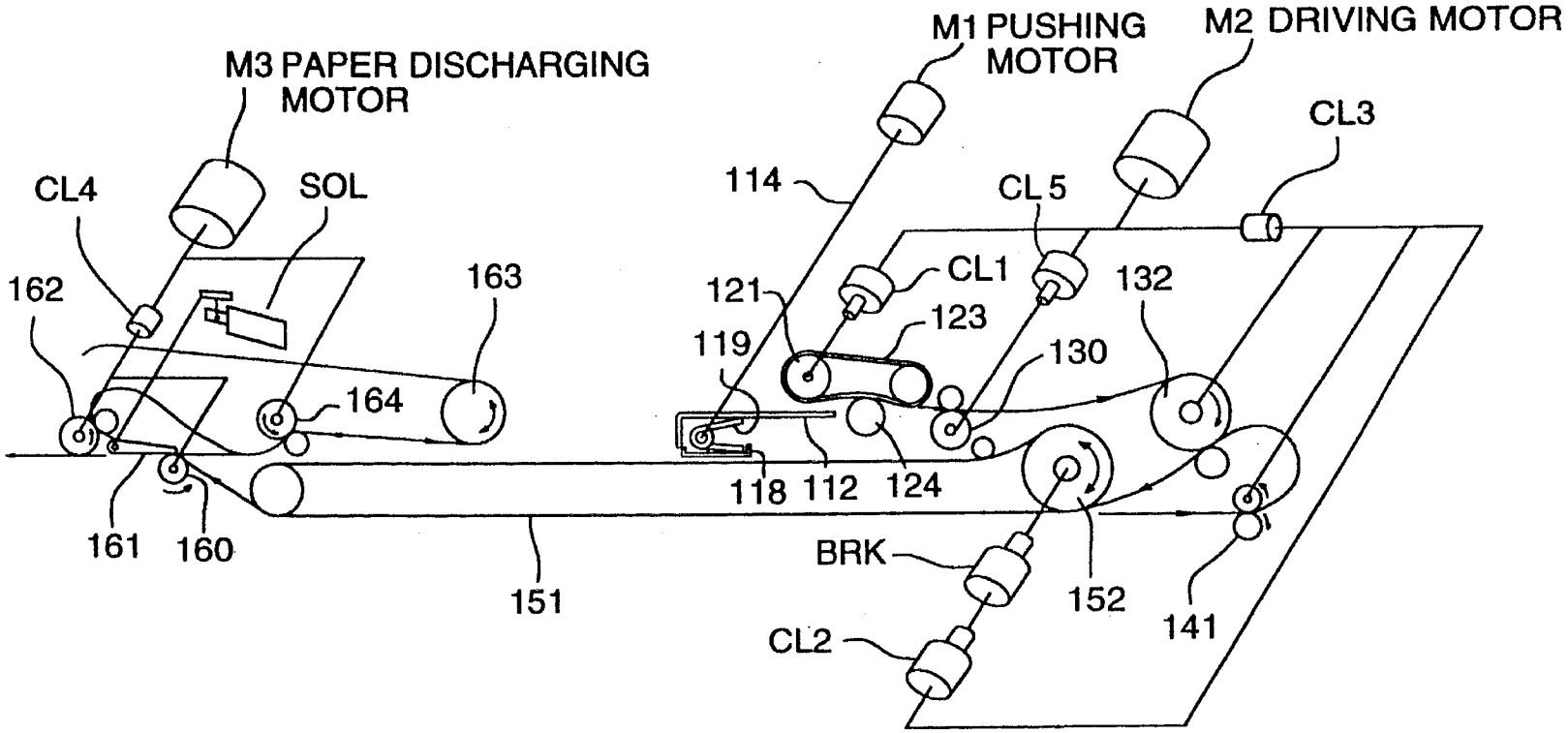
FIG. 3 is a schematic illustration showing the drive system (power transmission system) of the above automatic document feeding apparatus.

FIG. 2 is a sectional view of the automatic document feeder 10 of the present invention, and FIG. 3 is a schematic illustration showing the structure of the drive system (power transmission system) of the automatic document feeder. As illustrated in FIG. 1, the automatic document feeder 10 is disposed on the copier body 1, and includes: a document stack section 11 on which a document stack is provided; a paper feed section (paper feed means) 12 that separates a sheet of document D from the document stack; an intermediate conveyance section 13 that conveys document D sent from the paper feed section 12; a conveyance section 15 that conveys document D conveyed by the intermediate conveyance section 13 to a predetermined position on a platen glass 21; a document reversal means 14 that reverses the document conveyed by the conveying means 15 and feeds the document again to the conveyance means 15; and a paper discharge reversal section (paper discharging means) 16 that reverses the read document D and discharges the document to the paper discharge tray (paper discharge stack section) under the condition that the front and reverse sides of the document are not changed, or the paper discharge and reversal section 16 returns the document onto the document tray. The first conveying means comprises the paper feed section 12, the intermediate conveyance section 13, and the conveyance section 15; the second conveying means is conveyance section 15; and the third conveying means comprises the intermediate conveyance section 13 and conveyance section 15.

The document stack section 11 is provided with a stack tray 110 on which a document stack is loaded, and a width regulating plate 111 to regulate the width of documents is movably provided on the stack tray 110.

When document stack D is set on the stack tray 110, document set detection sensor PS1 detects the document stack, and the sign of ADF mode is displayed on a control panel of the copier body 1. When document stack D is set in a predetermined position, the document size (B5 to A3) is detected by document size sensor PS2 and inputted into the control section of the copier body 1.

Movable press plate 112 is disposed downstream of the stack tray 110 in the document flow direction. The movable press plate 112 is rotatably supported by an oscillating shaft 114. Drive plate 118 is fixed to the oscillating shaft 114 by screws, so that the drive plate 118 can be oscillated integrally with the oscillating shaft 114. Resilient deformation member (for example, a torsion spring) 119 is wound around the oscillating shaft 114, and both end portions of the deformation member 119 come into pressure contact with the drive plate 118, and the center portion of the deformation member 119 comes into pressure contact with the movable press plate 112.

Two actuator portions are provided to the drive plate 118. The actuator portion opens and closes an optical path of press detection sensor (for example, a photointerrupter) PS3 that is fixed to the movable press plate 112. The actuator portion opens and closes an optical path of home position detection sensor (for example, a photointerrupter) PS4 that is fixed to the fixed bottom plate 116, so that the home position of the drive plate 118 is detected.

The paper feeding section 12 is disposed downstream of document feed of the movable press plate 112. The paper feeding section 12 comprises of document leading edge stopper 120, drive roller 121, idle roller 122, feed belt 123 around both rollers 121 and 122, and reverse roller 124 located below to prevent double feeding. The drive roller 121 is driven (see FIG. 3) by drive motor M2 through magnetic clutch CL1.

Conveyance section 13 is provided on the downstream side of document conveyance of the paper feeding section 12. The conveyance section 13, which is rotated normally, includes first intermediate conveyance roller 130 which is driven (see FIG. 3) by a drive motor M2 through a clutch CL5, document detection sensor PS5, curved guide plate 131, and second intermediate conveyance rollers 132, which is rotated normally. In this way, a conveyance passage is formed to convey document D from the paper feed section 12 onto the platen glass 21.

A discharge paper reversing section 14 is provided under the second intermediate conveyance rollers 132 in the right portion of the platen glass as shown in FIG. 2. The discharge paper reversing conveyance rollers 141 are provided with one-way clutch CL3, so that they are always rotated normally. Numeral 142 is a curved guide plate connecting the nip position of the second intermediate conveyance rollers 132 with that of the discharge paper reversing conveyance rollers 141. The curved guide plate 142 forms the document inversion paper conveyance passage. Inversion detection sensor PS7 is provided in the inversion paper conveyance passage, and detects the document when it passes through the detection sensor PS7.

A conveyance means 15 is provided on the surface of the platen glass 21 in the following manner. The conveyance belt (endless belt) 151 is provided on the platen glass 21 in such a manner that the drive roller 152, idle roller (two shafts) 153, three document holding rollers 154 and tension roller 155 are rotatably wrapped by the conveyance belt 151. Clutch CL2 and brake BRK are mounted on the shaft of the drive roller 152, and the drive roller 152 is driven by drive motor M2.

The discharge paper reversal section 16 includes a discharge paper roller 160, changeover claw 161, a plurality of conveyance rollers 162, 163, 164, and guide plates 165, 166, 167. The discharge paper roller 160 and conveyance rollers 162 to 164 are driven by discharge paper motor M3. The discharge paper roller 160 and the conveyance roller 162 are normally rotated, and the conveyance rollers 163 and 164 are normally and reversely rotated. The changeover claw 161 is driven by solenoid SOL.

FIG. 3 is a block diagram showing an electrical configuration of the automatic document feeding apparatus according to the present invention.

The motors M1, M2, and M3, which drive the applied rollers to convey the document, the clutches CL1–CL5, the brake BRK, and the solenoid SOL for driving the changeover claw 161 are connected with the controlling unit (CPU) through the interface circuit. To the interface circuit, the sensors PS1–PS10, and the encoders 1–3 are further connected. Further, an operation unit is connected to the controlling unit.

The controlling unit, which receives the signals from the sensors and the encoders through the interface circuit, processes the signals with the other signals from the controller, and controls the respective motors, the clutches, and the solenoid. The controller unit controls the signals according to the controlling program stored in the ROM. When the controlling operation such as the start of the copying operation, the change of the reading modes, and the selection of discharging operations are executed with the operation unit, the respective signal is sent to the controlling unit (CPU).

Figures 7A, 7B:
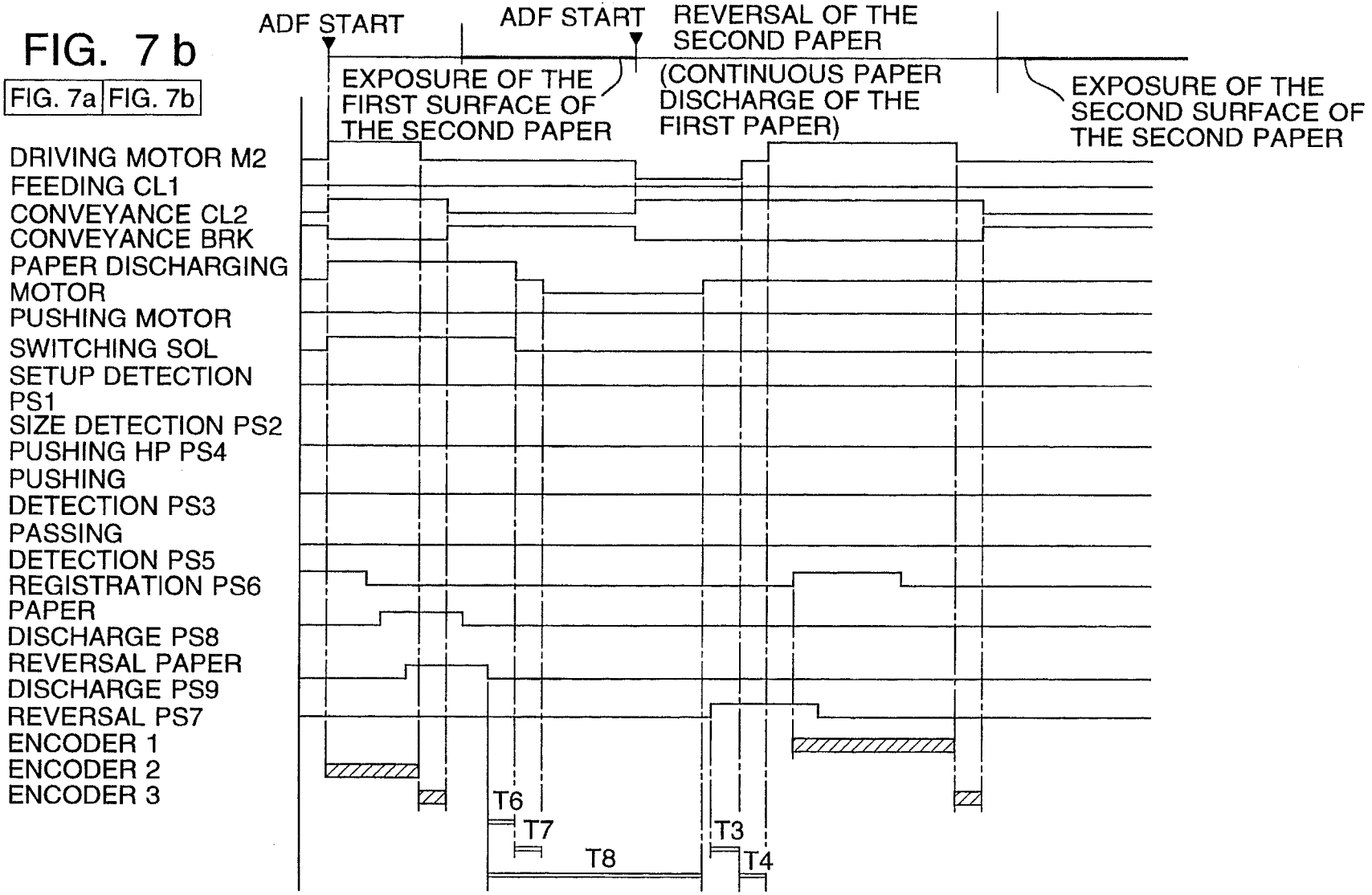
FIGS. 7(*a*) and 7(*b*) is a time chart for feeding and conveying two-sided documents in the first example.
Figure 8:
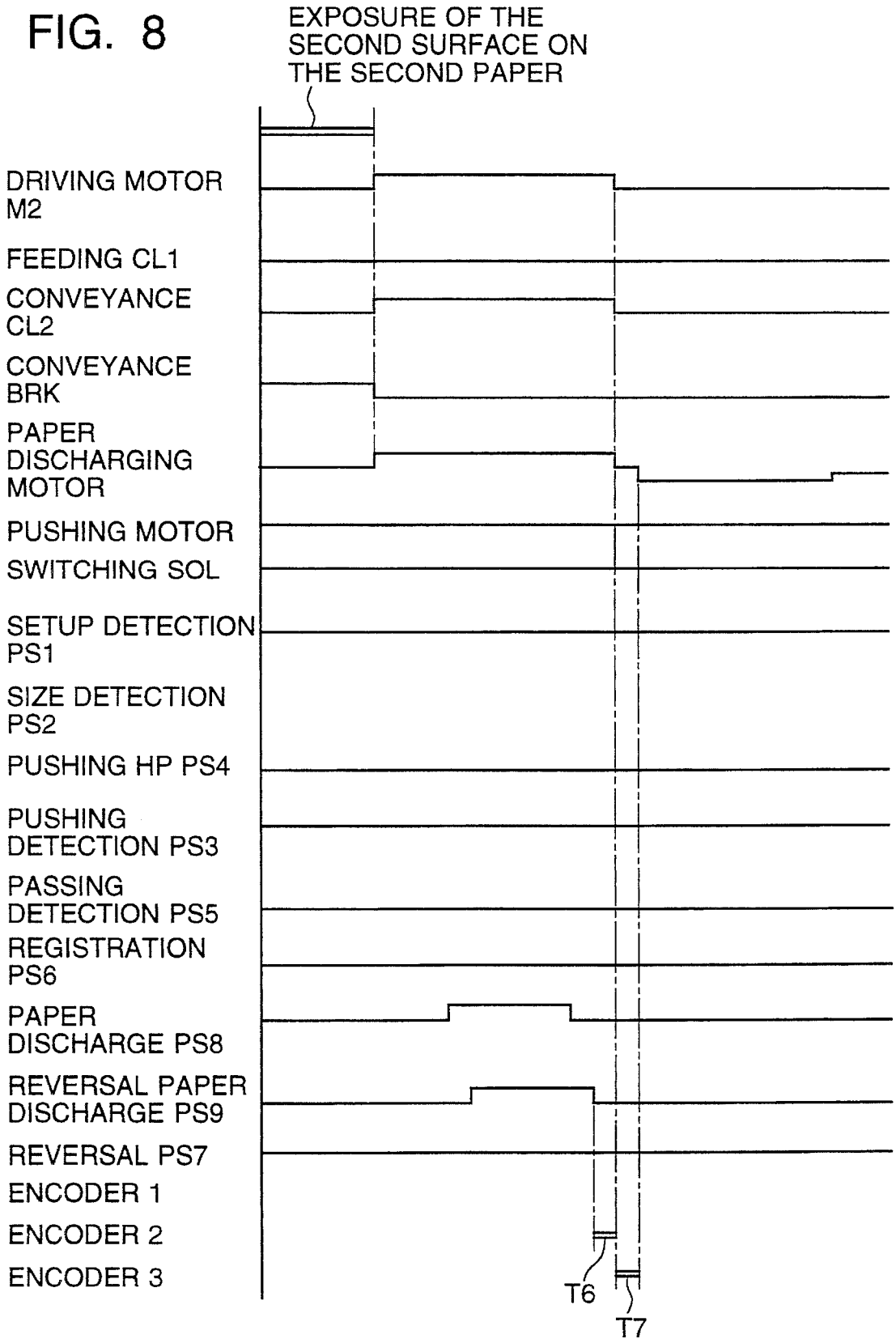
FIG. 8 is a time chart for feeding and conveying two-sided documents the first example.

FIGS. 4(A) to 6(L) are schematic illustrations according to the first example for explaining the progress of paper feeding, paper conveyance and paper discharging of a plurality of two-sided documents D (a document, on both surfaces of which images are formed). In the drawings, the one-dotted chain line shows the conveyance passage of two-sided document D. FIGS. 7 and 8 are timing charts expressing the progress of document feeding and conveyance of the automatic document feeder (RADF) of the first example.

Document feeding and conveyance operations are explained as follows.

(1) When the main switch of the copier body 1 is turned on under the condition shown in FIGS. 2 and 3, motor M1 for pressing is driven, and the initial stop position of the movable press plate 112 is detected by home position detection sensor PS4, whereby motor M1 for pressing is stopped. That is, home position detection sensor (the second detection member) PS4 is turned on in the home position.

In the case where the main switch is turned on and home position detection sensor PS4 is turned off, motor M1 is reversed, then the movable press plate 112 is lowered, and when it is detected that home position detection sensor PS4 has been turned on, motor M1 for pressing is stopped, and the drive plate 118 and movable press plate 112 are stopped at the initial position.

In the case where home position detection sensor PS4 is turned on, motor M1 for pressing is normally rotated for a moment so that home position detection sensor PS4 is turned off, then the movable press plate 112 is raised, and then motor M1 is reversed. After sensor PS4 has been turned on, motor M1 is stopped and the movable press plate 112 is set at the home position. This operation is effective for absorbing the time lag of drive gears and sensors. When the movable press plate 112 is set at the home position, a clearance is maintained in which the maximum amount of document stack D can be accommodated.

(2) When document stack D is placed on the stack tray 110 and the movable press plate 112, document set detection sensor PS1 is turned on and the device is set at the ADF mode (automatic document feeding mode). At the same time, document size sensor PS2 is turned on and the document size is detected.

(3) When the copy button is pressed, ADF operations can be started, so that copy operations can be started. Then, motor M1 (stepping motor) for pressing is rotated, so that the movable press plate 112 is oscillated through the drive member 118 secured to the oscillating shaft 114 and through the spring 119. The tip of the movable press plate 112 is raised so that stacked documents D are lifted. While the movable press plate 112 is being raised, the rotational angle of the oscillating shaft 114 is measured by a rotary encoder counting pulse count A.

(4) When the upper surface of documents D stacked on the movable press plate 112 comes into contact with the outer circumferential surface of the feed belt 123, the movable press plate 112 ceases holding the document stack. However, the drive plate 118 is further rotated counterclockwise compressing the torsion spring 119, so that a distance between the movable press plate 112 and the drive plate 118 is shortened.

(5) When the distance between the movable press 112 and the drive plate 118 reaches a predetermined value, an actuator provided on one end of the drive plate 118 turns on press detection sensor PS3 secured on the movable press plate 112, so that the pressure reaches an initial setting value (for example, 50 g) and the operation of pulse count A is stopped. Further, when the drive plate 118 is driven, the pressing force is increased, so that the movable pressing plate 112 presses document D against the feed belt 123 with a predetermined pressing force (for example, 100 g). After pressing, motor M1 for pressing is stopped.

In the manner described above, the document feeding preparation is completed, and successively the document feeding operation is started.

Feeding operations of two-sided documents will be explained as follows. A document stack composed of two documents of D1 and D2 will be explained here in order to simplify the explanation.

(A) FIG. 4(A) is a schematic illustration showing the document conveyance passage of the document feeder on which two-sided documents D1 and D2 are stacked. In FIGS. 2 and 3, both the first surface (1) of the upper first document D1 and the first surface (3) of the lower second document D2 are set face-up on the stack tray 110 and the movable pressing plate 112. When the documents are stacked, the automatic document feeder 10 is started, and the device is set at the ADF mode. Further, the two-sided copy mode is set when the two-sided document button is pressed on the control panel of the copier body 1.

(B) When the copy button on the control panel is pressed, motor M1 for pressing is started, and the movable pressing plate 112 is raised, so that the uppermost surface of document stack D1 and D2 comes into contact with the feed belt 123. Approximately at the same time, drive motor (main motor) M2 is turned on, and concurrently electromagnetic clutches $CL_1$ and $CL_2$ are turned on, so that the document feeding operation is started.

Figure 4:
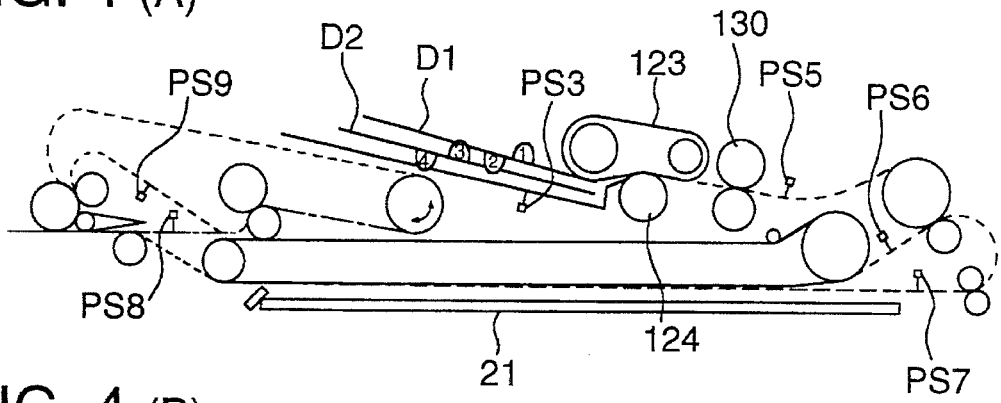
FIGS. 4(A) to 4(D) are schematic illustrations showing the operational procedure of paper feeding, paper conveyance and paper discharging for a plurality of two-sided documents according to the first example.
Figure 4:
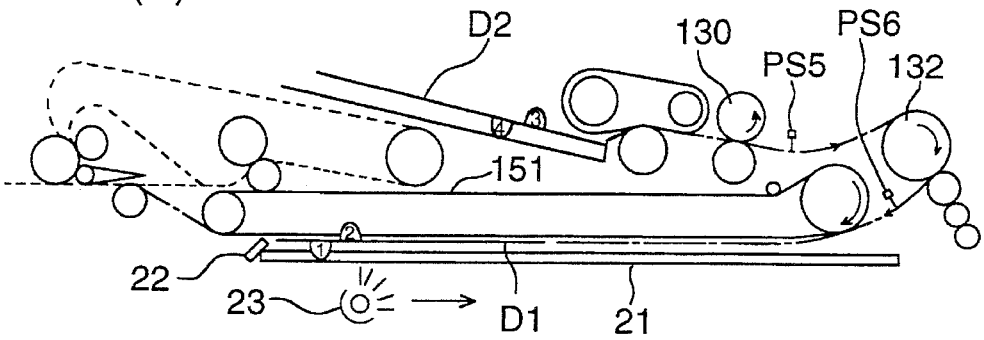
Figure 4:
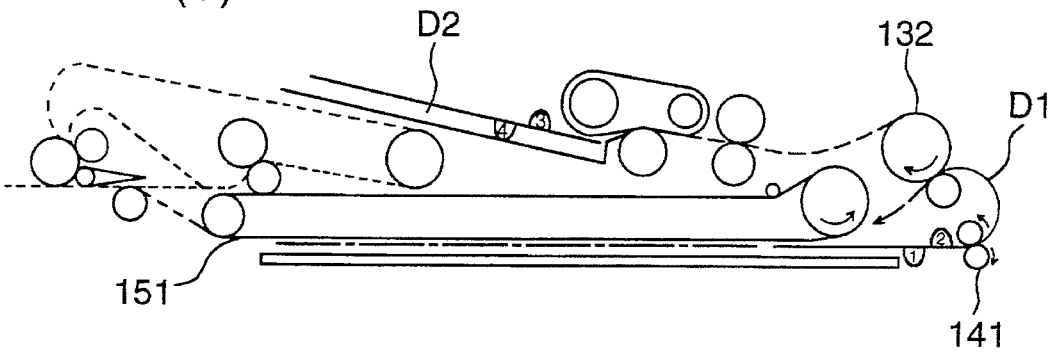
Figure 4:
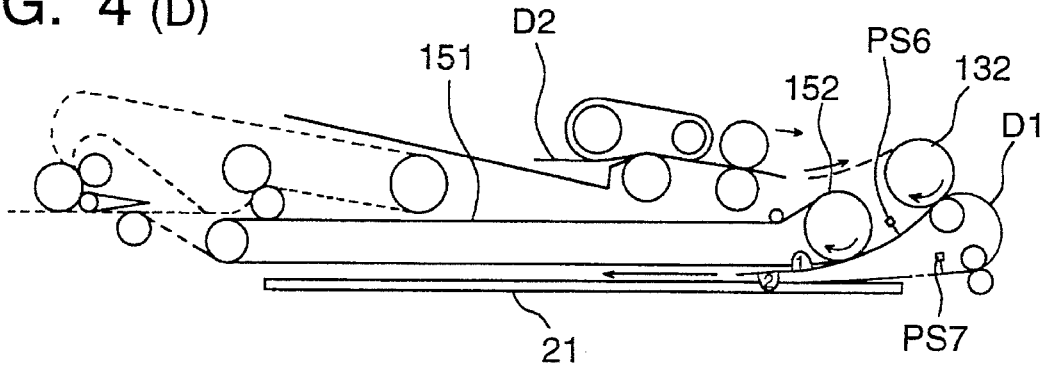
Figure 6:
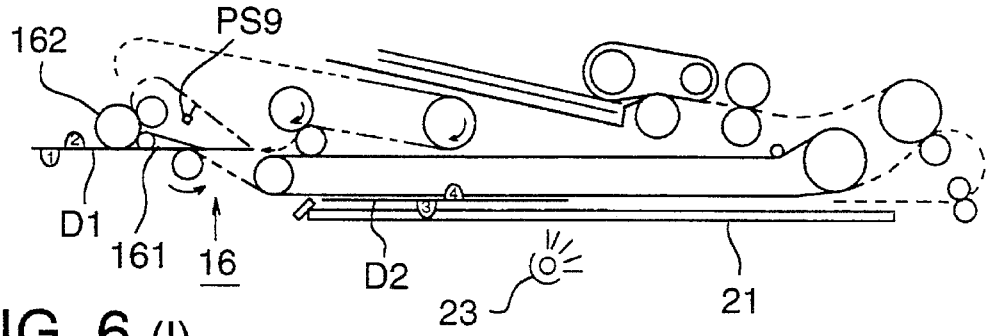
FIGS. 6(H) to 6(L) are schematic illustrations showing the document conveyance operational procedure of the first example.
Figure 6:
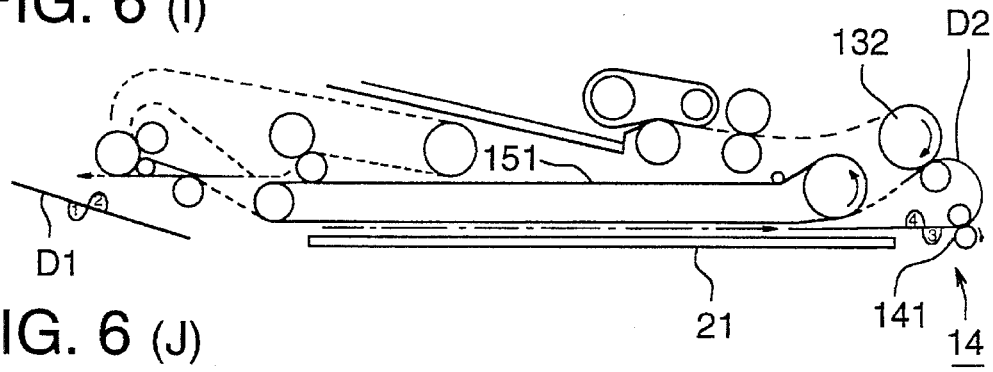
Figure 6:
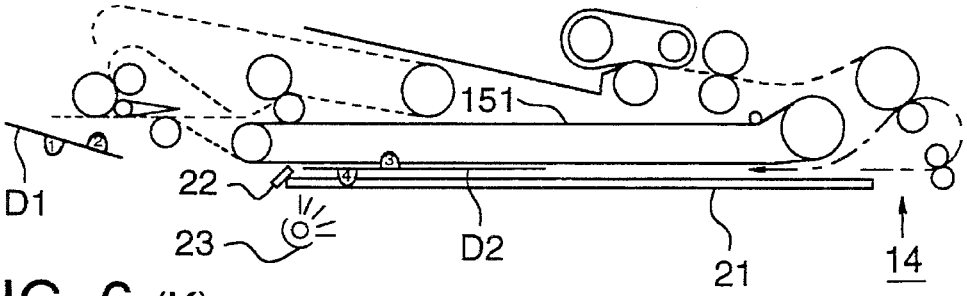
Figure 6:
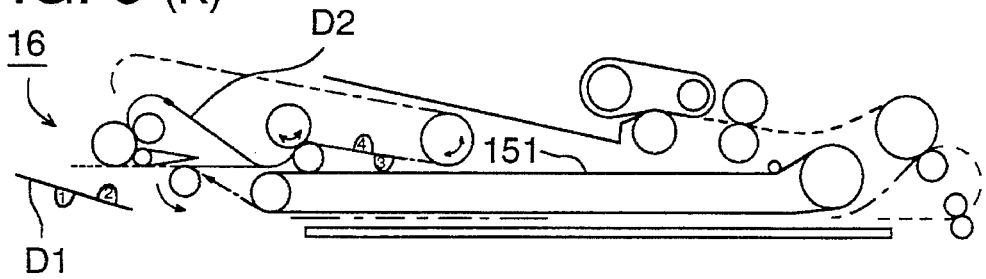
Figure 6:
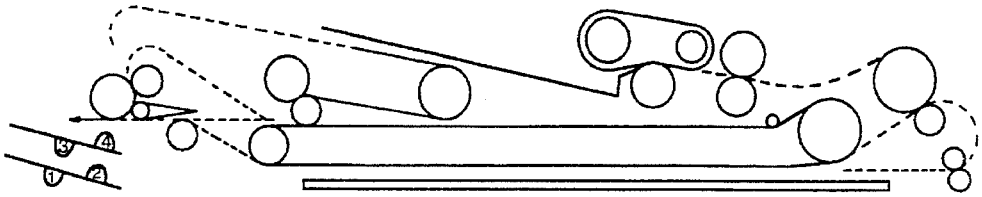

In FIG. 4, upper documents D are conveyed out by the feed belt 123 rotated by drive motor M2. Only the uppermost document D1 in the aforementioned several documents D is separated and fed by the reverse roller 124.

Document D1 separated in the aforementioned manner is nip-conveyed by the first intermediate conveyance rollers 130. When the leading edge of document D is detected by document sensor PS5, clutch CL1 that has driven the drive roller 121 is turned off. The feed belt 123 is idly rotated until the trailing edge of document D1 passes through sensor PS3, and after that the feed belt 123 is stopped.

When document sensor PS5 is turned on, motor M1 for pressing is switched to reverse rotation, so that the drive plate 118 and the movable pressing plate 112 are lowered, and the pressing motion is released.

When home position detection sensor PS4 detects that the drive plate 118 is returned to the initial position, motor M1 for pressing is stopped. In the case where a plurality of documents are successively fed, the drive plate 118 and the movable pressing plate 112 are not returned to the home position, but the lowering motions of the drive plate 118 and the movable pressing plate 112 are stopped halfway.

After the trailing edge of the first document D1 has passed and document sensor PS5 has been turned off, the pressing operation of the drive means is started in accordance with the detection signal, so that the drive plate 118 and the movable pressing plate 112 are raised to press the successive document (second document D2).

The first document D1 is conveyed out by the paper separation and conveyance means, and conveyed by the first intermediate rollers 130. The leading edge of the document is detected by document sensor PS5. The document passes through the guide plate 131, and is conveyed by the second intermediate rollers 132 disposed downstream of the guide plate 131. Further, the document is conveyed through the guide plate 133 disposed downstream of the second intermediate rollers 132.

When the leading edge of the document passes through registration sensor (document passing synchronizing sensor) PS6 disposed in the document passage, a detection signal is sent from the sensor so that the document conveyance operation can be controlled. That is, registration sensor PS6 controls the document stopper 22, motor M2 and paper feed clutch CL2 through a clock timer or an encoder directly connected with the conveyance belt shaft.

Next, in the conveyance means 15, the document is held and conveyed between the rotating conveyance belt 151 and the platen glass (reading section) 21. The leading edge of document D1 collides with the document stopper 22 that is protruded from the left upper surface of the platen glass 21 by the action of a solenoid not shown in the drawing. When the leading edge of document D1 collides with the document stopper 22, the movement of the document is stopped.

When the document is stopped on the platen glass 21, the first surface (1) of document D1 is irradiated by the exposure lamp 23 of the optical scanning exposure system 2, so that the document image is formed on the photoreceptor drum 31 through the lens and mirrors.

Exposure operations, the number of which is the same as that of the copied sheets, are carried out. In this way, a series of copying processes are conducted with regard to the first side of document D1.

(C) The operations are carried out as follows. After the copying operation of the first surface (1) of document D1 has been completed, drive motor M2 is reversely rotated, and therefore the conveyance belt 151 is reversely rotated. Document D1 on the platen glass 21 is nipped by the reversing conveyance rollers 141 that are rotated normally, and passes through the guide plate 142, and then the conveyance direction is reversed. Then, document D1 is held by the second intermediate rollers 132 that are normally rotated, and conveyed to the guide plate 133.

(D) The operations are carried out as follows. When the leading edge of document D1 is detected by the sensor PS6, drive motor M2 is switched to normal rotation by the detection signal, so that the drive roller 152 is rotated normally and the conveyance belt 151 is rotated in the normal direction. Therefore, inverted document D1 is slid to the left on the platen glass 21. When the trailing end of document D1 is detected by PS7, the timer starts, and after a certain period of time has been counted up, the conveyance of the second document D2 is started.

(E) In the middle of conveyance in which the second surface (2) of the first document D1 is conveyed to the exposure position (reading position), the second document D2 is held by the rotating conveyance belt 151 and the platen glass 21, so that the previous document D1 and the following document D2 are concurrently conveyed in the conveyance direction by the conveyance belt 151.

Concurrently when the first document D1 is stopped at the exposure position (reading position), the next document D2 stops and waits for the following operation at a waiting position located in an upstream position on the conveyance belt 151, wherein the second document D2 is separated from the first document D1 by a predetermined distance.

(F) After the exposure operation of the first document D1 has been completed, the changeover claw 161 is changed over downward so that the passage is changed over to information, and the conveyance belt 151 is normally rotated so as to send the document D1 to the paper discharge and reversal section 16. That is, when the paper discharging motor M3 is driven, document D1 is sent upward through the paper discharging roller 160, changeover claw 161 and conveyance roller 162, and then document D1 passes through the guide plate 167, conveyance roller 164, guide plate 166 and conveyance roller 163.

At the same time, the second document D2 is also conveyed from the waiting position where only the leading end is held by the conveyance belt 151, onto the platen glass 21, and comes into contact with the document stopper 22 so that the reading position of the document is determined.

(G) The operations are carried out as follows. Even while the first surface (3) of document D2 at the exposure position on the platen glass 21 is being irradiated, the first document D1 is being conveyed in the conveyance passage in the discharged paper reversal section 16.

(H) While document D2 is being exposure-scanned, the first document D1 is conveyed in the following manner:

The first document D1 is conveyed passing through the paper discharge and reversal section (paper discharge means) 16. When the trailing end of the document is detected by reversal discharge paper sensor PS9, discharge paper motor M3 is reversed after a predetermined period of time has passed. Then, the changeover claw 161 is changed over upward, and the document is discharged onto the discharge paper tray (discharge paper stack section) 168 under the condition that the first surface is set downward.

In this case, the leading and trailing ends of the document D2 in the reading section is reversed while document D1 is being discharged. Therefore, when the document is reversed by the reversal means, the relation of the leading and trailing ends that has been reversed can be returned to the original condition.

In this case, until the reading operations of the first surface (3) and the second surface (4) of document D2 have been completed, a new document is not sent into the paper discharge reversal section 16. Therefore, a period of time in which the second surface (4) of the next document D2 is being read can be fully used for discharging and reversing the document. Accordingly, in the paper discharge reversal section 16, after a predetermined period of time has passed after the detection of the trailing end by reversal paper discharge sensor PS9, paper discharge motor M3 is reversed. At this time, the document is conveyed at a conveyance speed lower than the document replacing speed and discharged onto the discharge paper tray 168.

As a result of the foregoing, the paper discharge speed can be reduced during paper discharge conveyance, so that the documents are properly discharged onto the discharge paper tray without jumping out of it and also they can be excellently aligned in the tray. As described above, in the two-sided document copy mode, the reversal conveyance operations can be smoothly performed in the paper discharge reversal section 16.

(I) Document D2, the first surface (3) of which has already been exposed, is reversely conveyed on the platen glass when the conveyance belt 151 is reversed, and then document D2 is held and conveyed by a pair of reversal conveyance rollers 141 of the reversal means 14 and also by a pair of second intermediate conveyance rollers 132.

(J) Document D2 that has passed through the conveyance passage in the reversal means 14 sent to the right end portion on the platen glass 21 under the condition that the front and rear sides are reversed. Then, the document is held and conveyed by the conveyance belt 151 on the platen glass 21, and comes into contact with the document stopper 22 and stops. The same exposure-scanning operation as described before is conducted on the second surface (4) of document D2 that has been stopped in the aforementioned manner.

(K) After both sides have been exposed, document D2 is conveyed by the conveyance belt 151 and sent to the paper discharge reversal section 16, and the front and rear sides of the document are reversed here and then conveyed out.

(L) After the front and rear sides have been reversed by the paper discharge reversal section 16 (paper discharge means), document D2 is discharged onto the discharge paper tray 168 (discharge paper stack section) and stacked on the previous document D1.

In the one-sided document copy mode, a document is sent onto the platen glass 21 from the second intermediate conveyance rollers 132 of the second conveyance section 13. After a reading operation of the document has been completed, the document passes through the paper discharge roller 160 of the paper discharge reversal section 16 and the lower surface of the changeover claw 161. After that, the document is accommodated in the discharge paper tray 168 (discharged paper stack section) under the condition that the front and rear sides of the document in the reading section are not changed.

That is, the paper discharge means corresponds to the first and second paper discharge means. In this example, in the two-sided document copy mode (two-sided document reading mode), the second paper discharge means is operated so that the front and rear sides of a document are changed and then the document is discharged. In the one-sided document copy mode (one-sided document reading mode), the first paper discharge means is operated and the document is discharged under the condition that the front and rear sides of the document are not changed.

As explained above, in the automatic document feeding apparatus of the present example, the operation is conducted in the following manner: In the case where the two-sided document copy mode has been selected, a sheet of the two-sided documents on the document tray (stack tray) 110 is sent out, and the first surface (1) of document D1 is read by the reading section of the optical scanning exposure system. Then, the document surface is reversed by the reversal means 14, and while the second surface (2) of document D1 is being conveyed to the reading position again, the second document D2 is sent out, and the first document D1 and the second document D2 are concurrently conveyed by the conveyance means 15.

Concurrently when the second surface (2) of the first document D1 had reached the reading position, the second document D2 is conveyed to the waiting position located upstream of the first document D1 by a predetermined interval. After the second surface of the first document has been read, the discharge of the first document D1 and the conveyance of the first surface of the second document D2 to the reading position are concurrently performed. The aforementioned operation is repeated until all documents are processed.

According to the aforementioned document conveyance process, while the second surface (2) of the first document D1 is read, the second document D2 can be made to wait for the following operation at a position close and the upstream of document D1 being held by the conveyance belt 151.

Accordingly, after the second surface (2) of the first document D2 has been read, the first surface (3) of the second document D2 can be conveyed to the reading position in a short period of time. As a result of the foregoing, the document conveyance time can be reduced, so that the copy productivity can be remarkably increased.

That is, the reversed first document and the second document are concurrently conveyed, so that the second document D2 can be made to wait for the following operation in the conveyance range of the conveyance belt 151 together with the first document D1. Therefore, the second document D2 can wait at a position closest to the first document D1 without being restricted by the conveyance distance of the conveyance belt 151.

In the first example, the document stack tray and the discharge paper stack section are separately disposed. However, a circulation type document feeding apparatus may be adopted in which the documents that have already been read are circulated onto the document stack tray. In this case, between the reading section and the discharged paper stack section, a document may be switched back by an odd number of times, and then the document may be discharged onto the document stack tray.

Next, the second example of the present invention will be explained as follows. This example is also constituted as illustrated in FIGS. 1 to 3 in the same manner as example 1. As shown in the drawings, the intermediate conveyance section 13 is provided in the downstream portion of document conveyance of the paper feeding section 12. The intermediate conveyance section 13 includes a pair of first intermediate conveyance rollers 130 driven by drive motor M2 through conveyance clutch CL5, passing document detection sensor PS5, curved guide plate 131, and a pair of second intermediate conveyance rollers 132 that are always normally rotated through one-way clutch CL3. The above units form a conveyance passage through which document D sent out from the paper feeding section 12 is conveyed to one end of the platen glass 21.

Figure 12:
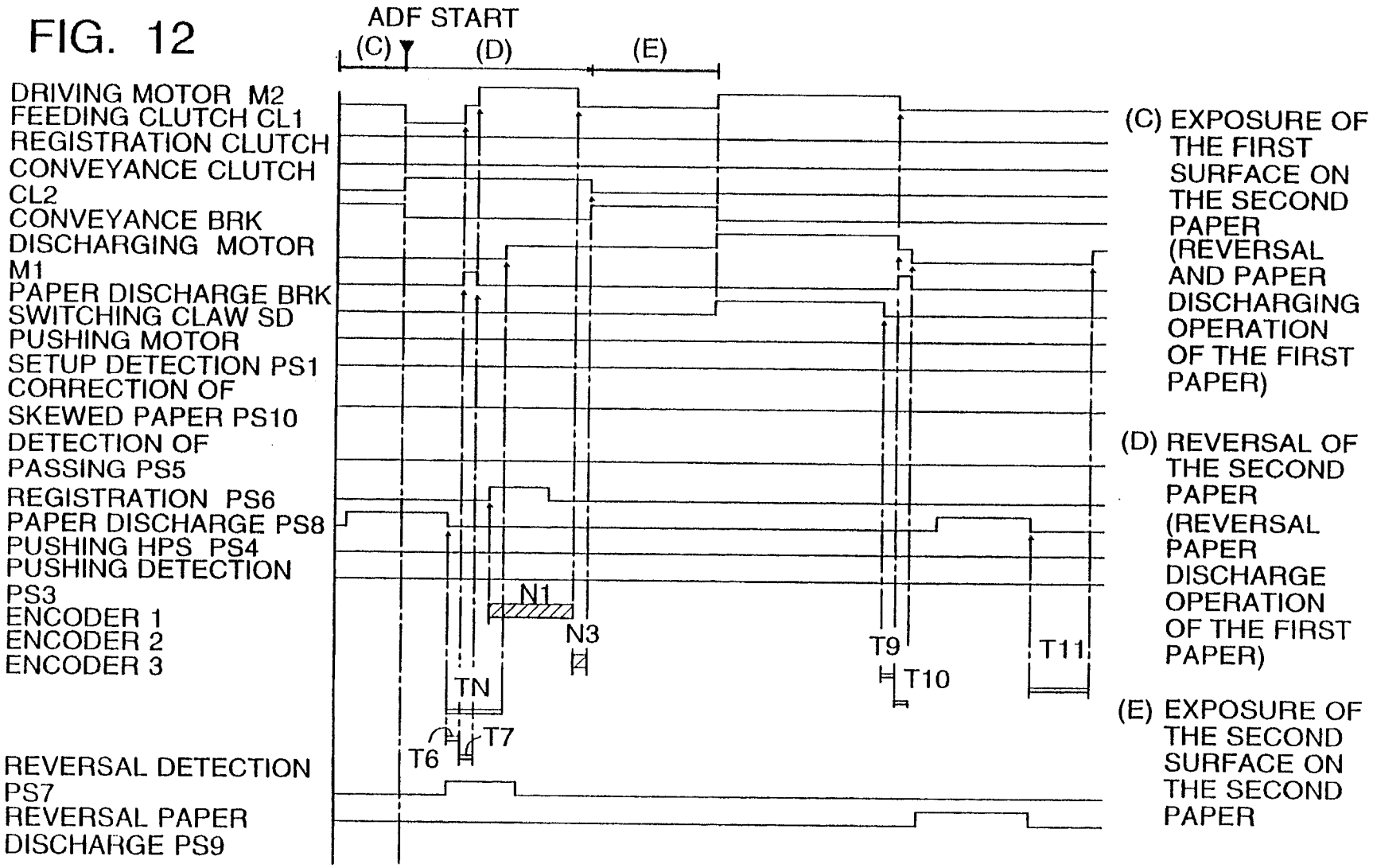
FIG. 12 is a time chart for feeding and conveying two-sided documents in the second example.
Figure 13:
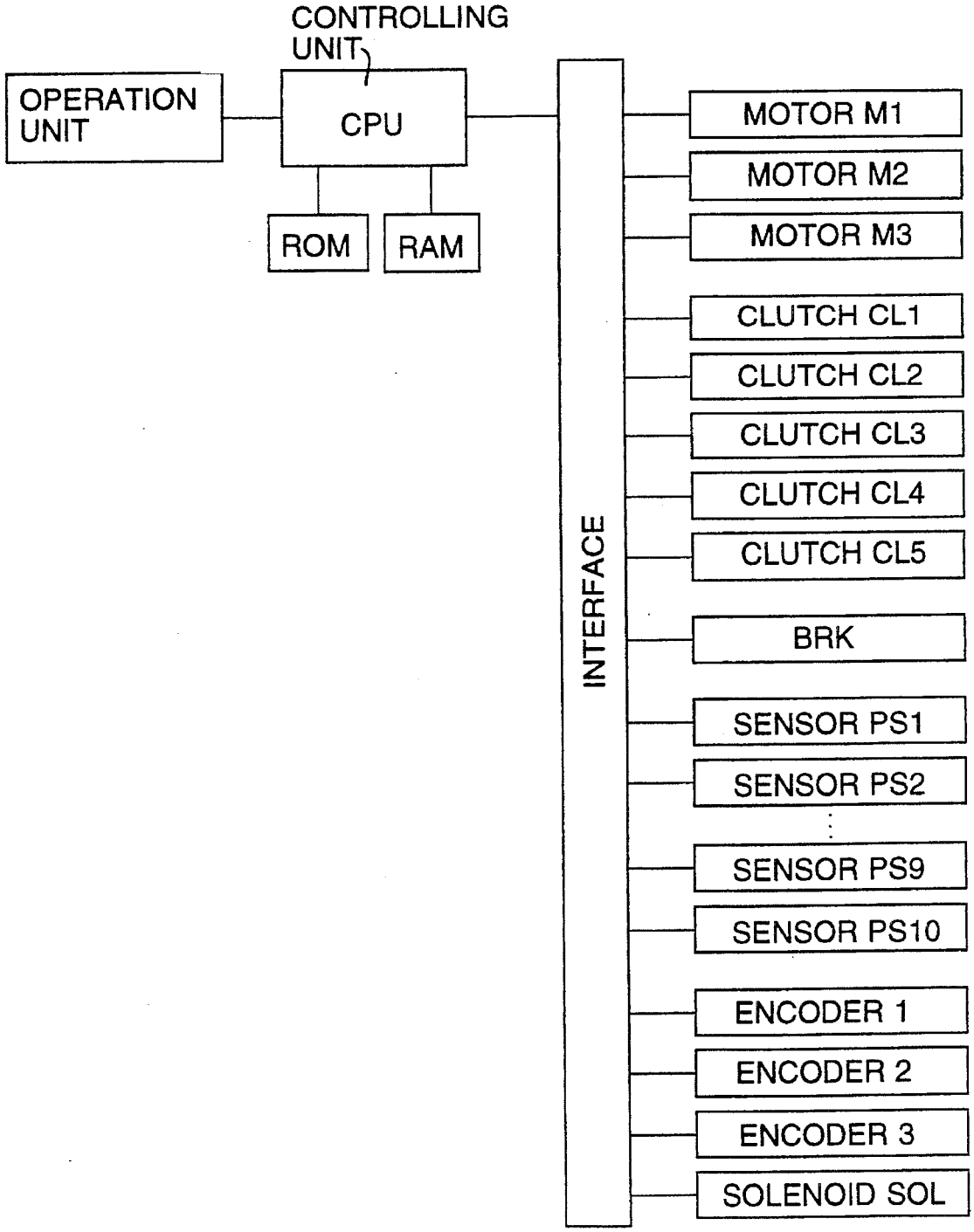
FIG. 13 is a block diagram showing an electrical configuration of the automatic document feeding apparatus according to the present invention.

FIGS. 9(A) to 9(D) and FIGS. 10(E) and 10(F) are schematic illustrations for explaining the operational procedure carried out when a plurality of two-sided documents D (images are formed on both sides of the documents) are fed, conveyed and discharged. These drawings are characteristic of the second example. In the drawings, one-dotted chain line represents a conveyance passage of two-sided documents D. FIGS. 11 and 12 are time charts of the document feed and conveyance operation procedure of the automatic document feeding apparatus (RADF) of the second example.

Characteristics of the document feeding operation of the second example will be explained as follows.

Figure 9:
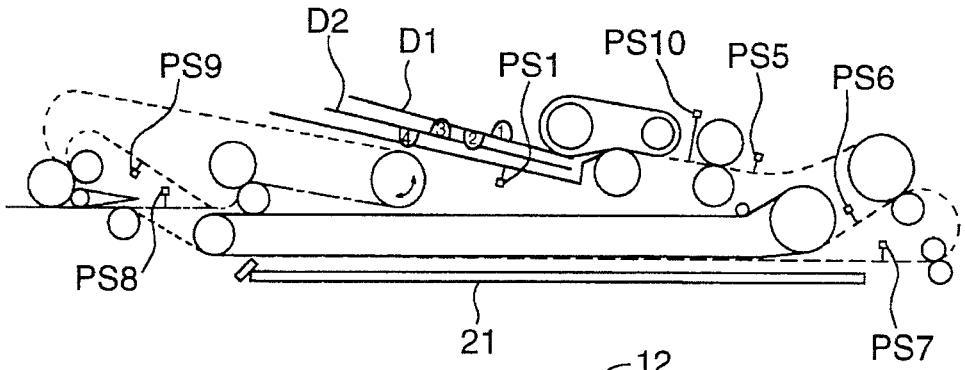
FIG. 9(A) to 9(D) are schematic illustrations showing the operational procedure of paper feeding, paper conveyance and paper discharging for a plurality of two-sided documents according to the second example.
Figure 9:
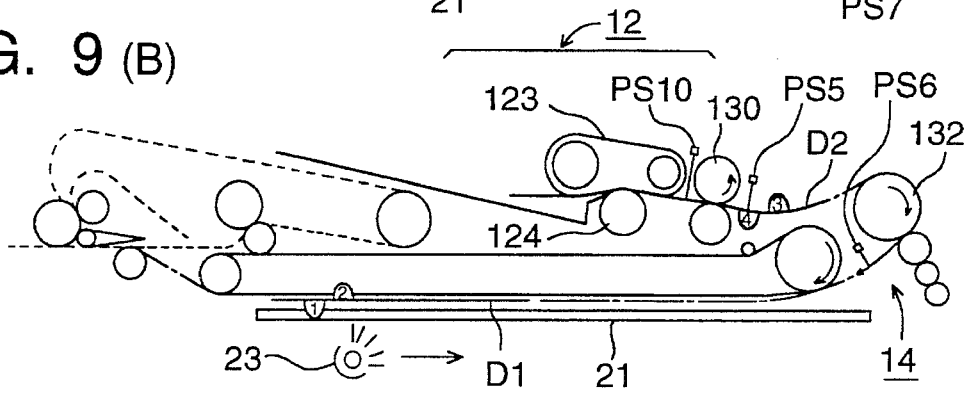
Figure 9:
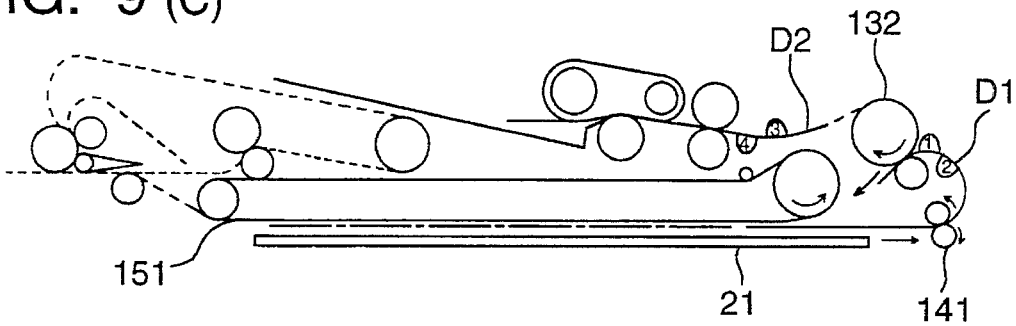
Figure 9:
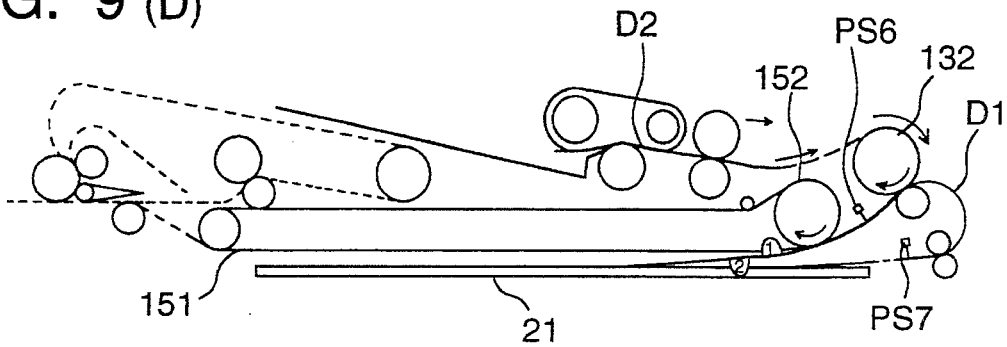

(A) FIG. 9(A) is a schematic illustration showing a document conveyance path of an automatic document feeding apparatus prepared for feeding the two-sided documents D1 and D2. In the drawing, the first surface (1) of the upper first document D1 and the first surface (3) of the lower second document D2 are set upward and respectively placed on the stack tray 110 and the movable pushing plate 112. When the documents are set, the automatic document feeding apparatus 10 starts, and the ADF mode is set. Further, when the two-sided document designation button on the control panel of the copier body 1 is pressed, the two-sided copy mode can be set.

(B) Next, when the copy button on the control panel is turned on, motor M1 for pushing starts, and the movable pushing plate 112 is raised, so that the uppermost surfaces of document bundles D1 and D2 are contacted with the feed belt 123, and approximately at the same time, drive motor (main motor) M2 is turned on and clutch CL1 is concurrently turned on. In this way, the document feeding operation is started as follows.

The upper document D is sent out by the feed belt 123 rotated by drive motor M2, and further only the uppermost document D1 is separated from a plurality of documents D sent out by the reverse roller 124 and conveyed.

When the leading end of a document D separated and conveyed in the manner described above is detected by the skew correction sensor PS10, a counting operation is started by timer T1. When timer T1 is counted up, drive motor M2 is turned off. In this case, the value of timer T1 is set so that the leading end of the document collides with the first intermediate conveyance roller 130 that has been stopped when conveyance clutch CL5 is turned off, and the skew of the document is corrected. When the document feeding speed is set low in the above operation, that is, when the document feeding speed is set at a value that is about half of the document replacing speed, the document skew correcting operation can be further stabilized.

When the leading end of a document is detected by the skew correction sensor PS10, timer T2 starts counting, and when timer T2 completes the counting operation, drive motor M2 and clutches CL1, CL2, CL5 are turned on, and the document is conveyed again. In accordance with the start of document conveyance, the conveyance speed is switched to a high speed. When the leading end of the document crosses the document passing detection sensor PS5, clutch CL1 that has been driving drive roller 121 is turned off, and then the feed belt 123 is idly rotated until the trailing end of document D1 passes through sensor PS3. After that, the feed belt 123 is stopped.

After the trailing end of the first document D1 has passed through the document passing detection sensor PS5, it is turned off, and according to the detection signal of the sensor PS5, the pushing operation of the drive means is started, and the drive plate 118 and the movable pushing plate 112 are raised, and successively the following document (next document D2) is pushed.

The first document D1 that has been sent out by the paper feeding means and conveyed by the first intermediate rollers 130, is detected by the document passing detection sensor PS5 when the leading end of the document passes through the sensor. Then, the document passes under the guide plate 131 and is conveyed by the second intermediate conveyance rollers 132 arranged downstream, and further the document passes between the guide plates arranged downstream.

When the leading end of the document passes through the registration sensor (document passing synchronization sensor) PS6 disposed in this document passage, the registration sensor PS6 sends a detection signal so that the document conveyance is controlled. That is, the registration sensor PS6 controls drive motor M2 and paper feeding clutch CL2 with a count provided by an encoder directly connected to the clock timer or the conveyance belt shaft.

Next, document D1 is held between the rotating conveyance belt 151 of the conveyance means 15 and the platen glass 21 (reading section), and conveyed while the document is being pressed against the platen glass 21. The document conveyance operation is stopped in accordance with the count provided by the encoder directly connected to the clock timer or the conveyance belt.

In this example, there is provided an encoder sensor for detecting the output of an encoder not shown directly connected with the conveyance belt. When the registration sensor PS6 detects the leading end of the document, a counting operation of the encoder sensor is started, and after a predetermined number of counts (N1) have been provided, the drive motor is turned off.

The conveyance belt and the second intermediate conveyance rollers are rotated while their speeds are decreased by the action of inertia force and load. At this time, the counting operation is further continued by the encoder. When a predetermined number of counts (N3) have been achieved, clutch CL2 is turned off, and at the same time brake BRK is turned on so that the document conveyance is forcibly stopped. Of course, the document may be stopped by a mechanical means such as a document stopper.

While the first surface (1) of the first document D1 is being exposed, the second document D2 is sent out by the paper feeding means, and the leading end of the document is detected by the skew correction sensor PS10. Then, a counting operation is started by timer T1. When the counting operation of timer T1 is completed, the drive motor M2 is turned off. In this case, the value of timer T1 is set so that the leading end of the document collides with the first intermediate conveyance roller that has been stopped when conveyance clutch CL5 is turned off, and the skew of the document is corrected. When the document feeding speed is set low in the above operation, that is, when the document feeding speed is set at a value that is about a half of the document replacing speed, the document skew correcting operation can be further stabilized.

When the leading end of a document is detected by the skew correction sensor PS10, timer T2 starts counting, and when timer T2 completes the counting operation, drive motor M2 and clutches CL1, CL2, CL5 are turned on, and the document is conveyed again. In accordance with the start of document conveyance, the conveyance speed is switched to a high speed.

When the leading end of the document crosses the document passing detection sensor PS5, a counting operation is started by timer T4. When timer T4 completes counting operation drive motor M2 and clutches CL1, CL2, CL5 are turned off. Then, timer T4 is set so that the document can be stopped at the first waiting position being nipped by the first intermediate roller, wherein the first waiting position is located between the paper feeding means 12 and the reversal means 14 and outside of the document conveyance passage of the reversal means 14 so that the reversal operation for the first document D1 can not be obstructed. The second document D2 waits for the next operation at this first waiting position until the reading of the first surface (1) of the first document D1 is completed and the first document D1 is reversed.

(C) After the first surface (1) of document D1 has been copied, the operation is carried out as follows:

Drive motor M2 is switched to a reverse drive operation, and the conveyance belt 151 is reversely rotated. Document D1 on the platen glass 21 is nipped by the reversal conveyance rollers 141 that are normally rotated, and passes through the guide plate 142. Then, document D1 is reversed, and held by the second intermediate conveyance rollers 132 that are normally rotated, and the leading end of the document advances into the guide plate 133.

(D) When the leading end of document D1 is detected by sensor PS6, drive motor M2 is switched to a normal rotational operation by the detection signal. Accordingly, the drive roller 152 is normally rotated, so that the conveyance belt 151 is normally rotated. Therefore, the reversed document D1 is slid on the platen glass 21 to the left in the drawing. In this case, when the trailing end of document D1 is detected by sensor PS7, timer T8 is started. After a counting operation has been completed, the conveyance of the second document D2 waiting at the first waiting position is started.

Figure 10:
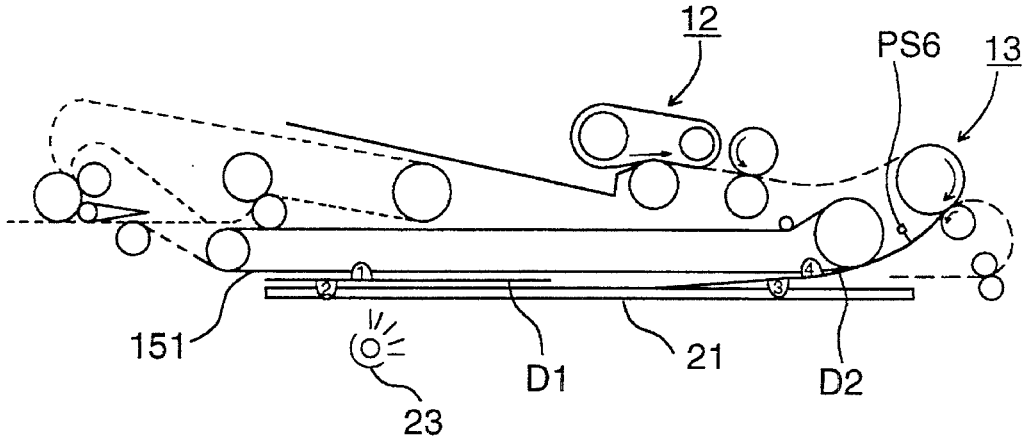
FIGS. 10(E) and 10(F) are schematic illustrations showing the document conveyance operational procedure of the second example.
Figure 10:
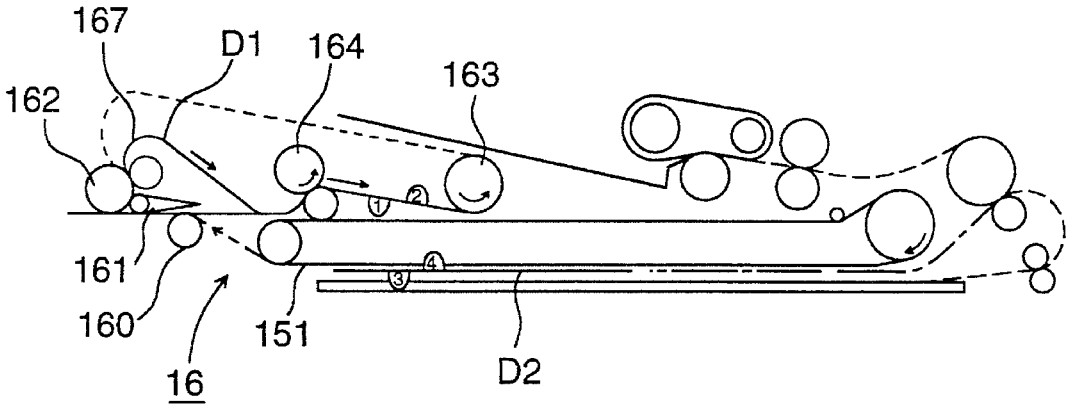

(E) Referring to FIG. 10, while the second surface (2) of the first document D1 is being conveyed to the exposure position (reading position), the second document D2 is held by the rotating conveyance belt 151 and the platen glass 21, so that the first document D1 and the second document D2 are concurrently conveyed to the conveyance direction by the conveyance belt 151. Concurrently when the first document D1 stops at the exposure position (reading position), the second document D2 waits for the following operation at the second waiting position located upstream on the conveyance belt 151 separated by a predetermined distance so that at least the leading end of the next document is positioned in the middle of the conveyance belt 151.

At this time, when the leading end of the previous document D1 in the middle of a reversal operation crosses registration sensor PS6, a counting operation of the encoder is started. Since the leading end of the second document D2 also crosses the registration sensor immediately after that, the counting operation is independently conducted for each document. Therefore, when a counting operation for the reversed first document D1 is completed, a stopping operation is started, and a counting operation for the second document D2 is held.

(F) After the exposure operation for the first document D1 has been completed, the changeover claw 161 is switched downward so that the passage is switched upward, and the conveyance belt 151 is normally rotated, and document D1 is sent to the discharged paper reversal section 16. That is, when paper discharge motor M3 is concurrently driven, document D1 makes a U-turn upward through the paper discharge roller 160, changeover claw 161, and conveyance roller 162, and passes through the guide plate 167, conveyance roller 164, guide plate 166, and conveyance roller 163.

Concurrently, the second document D2 is moved on the platen glass 21 from the second waiting position in which the second document D2 is held by the conveyance belt 151 and the second intermediate conveyance rollers 132, and the counting operation that has been held is also restarted, and when a predetermined number of counts (N1) have been provided, the drive motor is turned off. The conveyance belt 151 and the second intermediate conveyance rollers 132 are rotated while their speeds are decreased by the action of inertia force and load. At this time, the counting operation is further continued by the encoder. When a predetermined number of counts (N3) have been achieved, clutch CL2 is turned off, and, at the same time, brake BRK is turned on so that the document conveyance is forcibly stopped, and the reading position is determined.

As described above, in the automatic document feeding apparatus of the second example of the present invention, one sheet of the two-sided documents stacked on the document stack tray 110 is sent out, and before the reading operation of the first surface (1) is completed in the reading section of the optical scanning exposure system, the second document is separated from the document stack and conveyed to the first waiting position. After the reading operation of the first surface (1) of document D1 has been completed, the document is reversed by the reversal means 14, and then the second surface (2) of document D1 is conveyed to the reading position. At this time, the first document D1 and the second document D2 waiting for the following at the first waiting position are concurrently conveyed in the conveyance direction.

As a result of the foregoing, the second surface (2) of the first document D1 is conveyed to the reading position, and at the same time, the second document D2 is conveyed from the first waiting position to the second waiting position located upstream of the first document D1 by a predetermined distance. After the reading operation of the second surface of the first document has been completed, the paper discharging operation of the first document D1 and the conveyance operation of the first surface (1) of the second document D2 from the second waiting position to the reading position are concurrently carried out, and the aforementioned operation is repeated until all documents are processed.

In the aforementioned document conveyance process, when the second surface (2) of the first document D1 is read, the second document D2 can be positioned upstream of the previous document D1 while the second document D2 is also being held by the conveyance belt 151. Accordingly, immediately after the second surface (2) of the first document D1 has been read, the first surface (3) of the second document D2 can be conveyed to the reading position in a short period time. As a result of the foregoing, the document conveyance time can be reduced, so that the copying productivity can be remarkably improved.

That is, since the reversed first document and the second document are concurrently conveyed, the second document D2 can be made to wait for the following operation together with the first document D1 in the conveyance range of the conveyance belt 151. Therefore, the second document D2 can wait at a position closest to the first document D1 without being restricted by the conveyance distance of the conveyance belt 151.

Before the reversed first document and the second document are concurrently conveyed, the second document D2 is previously separated from the document stack and positioned at the first waiting position so as to wait for the following operation. Accordingly, a sufficient amount of time can be provided for the waiting operation carried out at the first waiting position. Therefore, a document separating operation and a document posture correcting operation can be carried out at low speed. Accordingly, as compared with a case in which the document separation from the document stack tray and the document conveyance to the second waiting position are continuously performed, the document separation performance can be improved, and further an interval between the first and second documents can be stabilized, so that documents can be positively replaced.

In the second example of the present invention, the document stack tray and the discharged paper stack section are independently provided, however, they may be provided in combination and a document that has been read may be circulated to the document stack tray, that is, a circulation type document feeding apparatus may be adopted.

Although, the above-described example used belt members for the second conveying means, plural rollers can be applied to the present invention.

When the automatic document feeding apparatus disclosed in Japanese Patent Publication Open to Public Inspection Nos. 196654/1990 (corresponding to Japanese Patent Publication No. 4-81865) and 205964/1991 (corresponding to Japanese Patent Publication No. 5-45965) are combined with the automatic two-sided document feeding apparatus of the aforementioned first and second examples in which two-sided documents are copied at high speed, the copying productivity can be greatly improved even when two-sided copies are automatically made from two-sided documents.

According to the present invention, the following effects can be provided.

As explained above, according to the automatic document feeding apparatus of the present invention, the second document can be sufficiently made to approach the first document and wait for the following operation without being restricted by the conveyance distance of the conveyance means. Therefore, the document conveyance time can be further reduced, and when the document feeding apparatus of the present invention is applied to a copier, the copying productivity can be remarkably improved.

In the apparatus of the invention, the second document is previously separated from a document-stack and made to wait for the following operation at the first waiting position, and concurrently when the reversed first document is conveyed to the reading position, the second document is conveyed to the second waiting position from the first waiting position, so that the document replacing operation can be carried out in a short period of time while the following document is being positively separated from the document stack.

Document conveyance speed in the process of paper discharging can be reduced as compared with the conveyance speed of document replacement. Therefore, while the paper discharging operation is being smoothly carried out, the discharged documents can be excellently aligned.

What is claimed is:

1. An automatic document feeding apparatus for conveying a plurality of documents to an image reading section, said apparatus comprising:

a first conveyor for separately conveying each of a plurality of documents from a document stack section to said image reading section at which an image on each of said plurality of documents is read;

a second conveyor for conveying each of said plurality of documents from said image reading section to a document reversing section;

said document reversing section including means for turning over each of said plurality of documents;

a third conveyor for conveying each of said plurality of documents from said document reversing section to said image reading section; and a document discharging section including means for discharging each of said plurality of documents from said image reading section to a document receiving section of said apparatus;

wherein said first conveyor comprises a fourth conveyor for conveying each of said plurality of documents from said document stack section to a waiting position; and, while a first one of said plurality of documents is conveyed to said image reading section by said third conveyor, a second one of said plurality of documents is conveyed by said first conveyor to a waiting position following a trailing end of said first one of said plurality of documents, before said first one of said plurality of documents is discharged to said document receiving section;

and wherein said first one and said second one of said plurality of documents are conveyed in parallel when said first one of said plurality of documents is discharged from said image reading section.

2. The apparatus of claim 1, wherein said reversing section is located between said image reading section and said document stack section.

3. The apparatus of claim 1, wherein a leading end of said first one of said plurality of documents is positioned in the image reading section.

4. The apparatus of claim 1, wherein:

said document discharging section is disposed at an opposite side of said document reversing section; and said image reading section is disposed between said document discharging section and said document reversing section.

5. The apparatus of claim 1, wherein a leading end of said second one of said plurality of documents at said waiting position is disposed after said document reversing section.

6. The apparatus of claim 1, wherein:

said third conveyor includes an endless belt member which is supported by two axes; and said waiting position is defined where at least a leading end of said second one of said plurality of documents is in contact with said endless belt member.

7. The apparatus of claim 6, wherein a leading end of said second one of said plurality of documents at said waiting position is disposed after said document reversing section.

8. An automatic document feeding apparatus for conveying a plurality of documents to an image reading section, said apparatus comprising:

a first conveyor for separately conveying each of a plurality of documents from a document stack section to said image reading section at which an image on each of said plurality of documents is read;

a second conveyor for conveying each of said plurality of documents from said image reading section to a document reversing section;

said document reversing section including means for turning over each of said plurality of documents;

a third conveyor for conveying each of said plurality of documents from said document reversing section to said image reading section; and a document discharging section for discharging each of said plurality of documents from said image reading section to a document receiving section of said apparatus;

wherein while a first one of said plurality of documents is conveyed to said image reading section by said third conveyor, a second one of said plurality of documents is conveyed by said first conveyor to a waiting position following a trailing end of said first one of said plurality of documents, before said first one of said plurality of documents is discharged to said document receiving section;

said document discharging section having a normal mode, wherein each of said plurality of documents is discharged in a same orientation as that at said image reading section, and a reversing mode, wherein each of said plurality of documents is turned over after image reading at said image reading section and is discharged up side down; and a mode selector for selecting one of a two-side reading mode wherein images on both sides of each of said plurality of documents are read at said image reading section, and a one-side reading mode wherein an image on one side of each of said plurality of documents is read at said image reading section.

9. The apparatus of claim 8, wherein said first one of said plurality of documents is discharged by said document discharging section while images on both sides of said second one of said plurality of documents are read at said image reading section.

10. The apparatus of claim 8, wherein a first one of said plurality of documents is discharged by said document discharging section while images on both sides of a second one of said plurality of documents are read at said image reading section when said two-side reading mode is selected by said mode selector.

11. The apparatus of claim 8, wherein when said two-side reading mode is selected, said document discharging means discharges each of said plurality of documents in said reversing mode of said document discharging section.

12. The apparatus of claim 8, wherein:

a conveyance speed of said document discharging section is not less than a conveyance speed of said third conveyor while a trailing end of each of said plurality of documents is being conveyed by said third conveyor; and said conveyance speed of said document discharging section is less than said conveyance speed of said third conveyor after said trailing end of each of said plurality of documents is started to be conveyed by said document discharging section.

13. The apparatus of claim 8, wherein said document discharging section discharges said plurality of said documents to said document stack section so that said plurality of documents are circulated in said apparatus.

14. An automatic document feeding apparatus for conveying a plurality of documents to an image reading section, said apparatus comprising:

a first conveyor for separately conveying each of the plurality of documents from a document stack section to said image reading section at which an image on each of said plurality of documents is read;

a second conveyor for conveying each of said plurality of documents from said image reading section to a document reversing section;

said document reversing section including means for turning over each of said plurality of documents;

a third conveyor for conveying each of said plurality of documents from said document reversing section to said image reading section; and a document discharging section for discharging each of said plurality of documents from said image reading section to a document receiving section of said apparatus;

wherein, a second one of said plurality of documents is conveyed to a first waiting position before a reading operation for reading an image on a first side of a first one of said plurality of documents is finished, and while said first one of said plurality of documents is conveyed to said image reading section again by said third conveyor, said second one of said plurality of documents is conveyed by said first conveyor from said first waiting position to a second waiting position following a trailing end of said first one of said plurality of documents; and said first one and said second one of said plurality of documents are conveyed in parallel when said first one of said plurality of documents is discharged from said image reading section.

15. The apparatus of claim 14, wherein said first conveyor and third conveyor have a confluence point, and said first waiting position is located between said document stack section and the confluence point.

16. The apparatus of claim 14, wherein each of said plurality of documents is corrected for a document skew when each of said plurality of documents is conveyed to said first waiting position.

17. The apparatus of claim 14, wherein:

said third conveyor includes an endless belt member which is supported by two axes; and said second waiting position is defined where at least a leading end of said second one of said plurality of documents is in contact with said endless belt member.

18. The apparatus of claim 14, wherein said document discharging section discharges said plurality of said documents to said document stack section so that said plurality of documents are circulated in said apparatus.

19. A method of conveying documents, each document having a first surface and a second surface, and for copying both surfaces of each of said documents, the method comprising the steps of:

separating and individually feeding a first one of plurality of said documents to an image reading section;

reading, at said image reading section, said first surface of said first one of said plurality of documents;

turning over said first one of said plurality of documents at a reversing section so that an image on a second surface of said first one of said plurality of documents is read at said image reading section;

conveying a second one of said plurality of documents from a document stack section to a waiting position following a trailing end of said first one of said plurality of documents, which first one of said plurality of documents is turned over and being conveyed from said reversing section to said image reading section;

reading, at said image reading section, said second surface of said first one of said plurality of documents; and discharging said first one of said plurality of documents from said image reading section, while simultaneously conveying said second one of said plurality of said documents from said waiting position to said image reading section.

20. A method of conveying documents, each document having a first surface and a second surface, and for copying both surfaces of each of said documents, the method comprising the steps of:

separating and individually feeding a first one of a plurality of said documents to an image reading section;

reading, at said image reading section, said first surface of said first one of said plurality of documents;

conveying a second one of said plurality of documents from a document stack section to a first waiting position before a reading operation for reading an image on said first surface of said first one of said plurality of documents is finished;

turning over said first one of said plurality of documents at a reversing section so that an image on a second surface of said first one of said plurality of documents is read at said image reading section;

conveying the second one of said plurality of documents from said first waiting position to a second waiting position following a trailing end of said first one of said plurality of documents, which first one of said plurality of documents is turned over and being conveyed from said reversing section to said image reading section;

reading, at said image reading section, said second surface of said first one of said plurality of documents; and discharging said first one of said plurality of documents from said image reading section, while simultaneously conveying said second one of said plurality of documents from said second waiting position to said image reading section.

* * * * *